US010066911B1

(12) United States Patent
Worrell et al.

(10) Patent No.: US 10,066,911 B1
(45) **Date of Patent: *Sep. 4, 2018**

(54) METHODS OF PREPARING NITROCELLUSE BASED PROPELLANTS AND PROPELLANTS MADE THEREFROM

(71) Applicant: Orbital ATK, Inc., Plymouth, MN (US)

(72) Inventors: William J. Worrell, Draper, VA (US); Benjain R. Vaughan, Blacksburg, VA (US); Jeffrey D. Archambault, Christiansburg, VA (US); Milca Fils-Aime, Radford, VA (US)

(73) Assignee: Orbital ATK, Inc., Plymouth, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/654,387

(22) Filed: Jul. 19, 2017

Related U.S. Application Data

(63) Continuation-in-part of application No. 15/214,081, filed on Jul. 19, 2016, now Pat. No. 9,885,550, which is a continuation of application No. 14/841,151, filed on Aug. 31, 2015, now Pat. No. 9,395,164.

(60) Provisional application No. 62/043,975, filed on Aug. 29, 2014.

(51) Int. Cl.
*F42B 5/16* (2006.01)
*C06B 25/18* (2006.01)

(52) U.S. Cl.
CPC ..... *F42B 5/16* (2013.01); *C06B 25/18* (2013.01)

(58) Field of Classification Search
CPC ..... F42B 5/16; F42B 33/001; C06B 25/00; C06B 25/18; C06B 25/20; C06B 25/22; C06B 25/24; C06B 25/28; C06B 25/30
USPC ..... 102/531; 149/47–50, 94–97; 536/42, 41, 536/38, 37, 35
See application file for complete search history.

(56) References Cited

U.S. PATENT DOCUMENTS

| | | | |
|---|---|---|---|
| 1,562,093 | A | 11/1925 | Juer |
| 1,590,594 | A | 6/1926 | Taylor |
| 1,590,598 | A | 6/1926 | Taylor |
| 1,945,101 | A | 1/1934 | Tschudin |
| 1,953,398 | A | 4/1934 | Eskew |
| 1,968,466 | A | 7/1934 | Parsons |

(Continued)

FOREIGN PATENT DOCUMENTS

EP 1364931 A3 11/2003

OTHER PUBLICATIONS

PowerPoint Presentation Slides, "Nitrocellulose Specification: In Need of Analytical Resuscitation", NC IPT, Nov. 16, 2004, 12 pages.

(Continued)

*Primary Examiner* — Joshua E Freeman
(74) *Attorney, Agent, or Firm* — Christensen, Fonder, Dardi & Herbert PLLC

(57) ABSTRACT

Methods of preparing propellant compositions for power loads and firearms that include providing pre-shaped particle sized starting material, shaped consistent with a desired final propellant product shape, and thereafter nitrating and stabilizing the pre-shaped starting material using boiling stabilization processes. The resulting nitrated propellants of the methods reliably exhibit complete stabilization, high nitrogen substitution, high shelf life and acceptable ballistic performance.

22 Claims, 9 Drawing Sheets

(56) References Cited

U.S. PATENT DOCUMENTS

| | | | | |
|---|---|---|---|---|
| 1,978,071 | A | | 10/1934 | York |
| 2,027,144 | A | * | 1/1936 | Bake ..... C09B 67/0077 546/41 |
| 2,105,627 | A | | 1/1938 | Baker et al. |
| 2,131,764 | A | | 10/1938 | Stieg |
| 2,286,775 | A | | 6/1942 | Weldin |
| 2,297,734 | A | | 10/1942 | Wyler et al. |
| 2,543,928 | A | | 3/1951 | O'Neill et al. |
| 2,593,786 | A | | 4/1952 | O'Neill, Jr. |
| 2,643,611 | A | * | 6/1953 | Ball ..... C06B 45/12 102/290 |
| 2,877,709 | A | | 3/1959 | Duckworth |
| 2,890,615 | A | | 6/1959 | Lefebvre |
| 2,946,673 | A | * | 7/1960 | Grassie ..... C06B 21/0058 149/103 |
| 2,947,254 | A | | 8/1960 | Weiss |
| 2,982,643 | A | | 5/1961 | Reinhardt |
| 2,991,168 | A | | 7/1961 | Nadel |
| 3,037,247 | A | | 6/1962 | Preckel |
| 3,073,731 | A | | 1/1963 | Cohen et al. |
| 3,086,897 | A | | 4/1963 | Sollott et al. |
| 3,118,797 | A | | 1/1964 | Coffee |
| 3,218,907 | A | | 11/1965 | Beal et al. |
| 3,251,823 | A | * | 5/1966 | Murphy ..... C06B 21/0066 149/100 |
| 3,282,751 | A | | 11/1966 | Quinlan et al. |
| 3,329,743 | A | | 7/1967 | Coffee |
| 3,346,675 | A | * | 10/1967 | Sapiego ..... C06B 21/0008 149/96 |
| 3,348,445 | A | * | 10/1967 | Nadel ..... F42B 5/16 102/289 |
| 3,378,611 | A | | 4/1968 | Kincaid et al. |
| 3,422,170 | A | | 1/1969 | Brooks et al. |
| 3,447,983 | A | | 6/1969 | Camp et al. |
| 3,463,086 | A | | 8/1969 | Silva et al. |
| 3,534,018 | A | | 10/1970 | Brissaud et al. |
| 3,745,927 | A | * | 7/1973 | Tanner ..... F02K 9/34 102/531 |
| 3,747,532 | A | | 7/1973 | Berger |
| 3,779,826 | A | | 12/1973 | Shaver |
| 3,854,400 | A | | 12/1974 | Van Langenhoven |
| 4,386,569 | A | | 6/1983 | Deas |
| 4,401,809 | A | * | 8/1983 | Fair ..... B01J 19/1862 149/100 |
| 4,477,297 | A | | 10/1984 | Chi |
| 4,689,185 | A | * | 8/1987 | Lopata ..... F42B 5/32 102/205 |
| 6,692,655 | B1 | | 2/2004 | Martins et al. |
| 6,786,986 | B2 | | 9/2004 | Filho |
| 7,704,340 | B1 | | 4/2010 | Nauflett et al. |
| 7,726,245 | B2 | | 6/2010 | Quesenberry et al. |
| 8,133,335 | B2 | | 3/2012 | Racette et al. |
| 8,257,522 | B2 | | 9/2012 | Racette et al. |
| 8,696,838 | B1 | | 4/2014 | Faridi et al. |
| 2003/0192632 | A1 | | 10/2003 | Nelaev et al. |
| 2005/0193915 | A1 | | 9/2005 | Worrell, Jr. et al. |
| 2006/0180253 | A1 | | 8/2006 | Nickel et al. |
| 2007/0068610 | A1 | | 3/2007 | Nickel |
| 2009/0223611 | A1 | | 9/2009 | Racette et al. |
| 2009/0266263 | A1 | | 10/2009 | Quesenberry et al. |
| 2010/0275487 | A1 | | 11/2010 | Quesenberry et al. |
| 2012/0138200 | A1 | | 6/2012 | Racette et al. |
| 2012/0260814 | A1 | | 10/2012 | Worrell et al. |

OTHER PUBLICATIONS

"Detail Specification, Nitrocellulose", MIL-STL-244B, Nov. 12, 1996, 29 pages, www.everyspec.com.

Bladek, J., et al., "Testing the Chemical Stability of Smokeless Propellants", *Chem. Anal.*, (Warsaw), vol. 38, pp. 813-822, Jul. 1993.

"Military Standard Propellants, Solid: Sampling, Examination and Testing," 22 pages, Aug. 28, 1991, www.everyspec.com.

"Industrial Preparedness Measure: Study of Improved Methods of Drying Casting Powder," U.S. Naval Propellant Plant, Indian Head, Maryland, 143 pages, Mar. 25, 1965.

Hatcher, R.C., "Evaluation of SNPE 1-RDX as a Solid Rocket Propellant Ingredient," *Proc. of Insensitive Munitions & Energetic Materials Technology Symposium*, 10 pages, 2000.

"Preliminary Assessment Report Final 1947 Quitclaim Property; Former Gopher Ordnance Works, Rosemount, MN, Appendix T," Prepared by U.S. Army Corps of Engineers—Omaha District, Mar. 2006, 13 pages.

Grote, Kevin, "Ordinance Technology," www.ih.navy.mil, Indian Head Division, NSWC, *NAVSEA*, Sep. 3, 2008 (16 pgs.).

* cited by examiner

METHODS OF PREPARING NITROCELLUSE BASED PROPELLANTS AND PROPELLANTS MADE THEREFROM

CROSS REFERENCE TO RELATED APPLICATIONS

This application is a continuation-in-part of U.S. patent application Ser. No. 15/214,081, filed Jul. 19, 2016, which is a continuation of U.S. patent application Ser. No. 14/841,151, filed Aug. 31, 2015, issued as U.S. Pat. No. 9,395,164 on Jul. 19, 2016, which claims the benefit of U.S. Provisional Application Ser. No. 62/043,975, filed Aug. 29, 2014, all of which are incorporated herein by reference in their entireties.

FIELD OF THE INVENTION

The present disclosure relates to methods of making nitrocellulose based propellants and propellants and cartridges made therefrom. More specifically, the present disclosure relates to methods of making nitrocellulose based propellants comprising nitrating and stabilizing pre-shaped starting material, using boiling stabilization processes, whereby the resulting propellant comprises nitrocellulose particles of desired shapes and sizes exhibiting complete stabilization and having acceptable nitrogen substitution ranges.

BACKGROUND

The major ingredients of modern propellants are actually few. They consist of fuels, oxidizers and binders. Of the three basic ingredients of propellants, two, or even three, of these may be contained in the same material. Nitrocellulose ("NC") is an example of all three, when colloided. The minor ingredients, used to assist or tie together the major ingredients, are more numerous and sometimes more complex. The interactions of these major and minor ingredients, when combined into a practical solid propellant, are especially complex. Such interactions can take place at all stages of manufacture, storage, and use. Controlling such interactions makes solid-propellant technology intricate and expensive.

Solid propellants are typically divided into classes according to their physical state. Such classes include homogeneous (single-base or double-base) and composite. Double-base propellants are further subdivided according to manufacturing method extruded or cast. As used herein, the term "single base propellant" means and includes a composition that includes an energetic binder, such as NC, and at least one additive, such as, a plasticizer, a ballistic modifier, a stabilizer, a flash suppressor. As used herein, the term "double base propellant" means and includes a composition that includes at least one energetic binder, such as NC, and at least one energetic plasticizer, such as a nitrate ester. For example, the double base propellant may include NC plasticized with the nitrate ester nitroglycerine ("NG").

Typical traditional methods of NC based propellant production include two separate processes, an NC production process and thereafter a propellant production process. In the NC production process, cellulose material is processed to produce NC. The NC may be mixed with prepared nitroglycerin ("NG") to produce an NC/NG mixture. NC may be used to produce single-base propellant and NC/NG may be used to produce double-base propellant. In the propellant production process, the produced NC or NC/NG is acquired and is separately processed to produce specific propellants.

The NC production process typically includes, in order, the steps of 1) cutting cellulose material; 2) preparing an acid mixture for nitration; 3) nitrating the cut cellulose in the acid mixture to produce NC, wherein the acid mixture converts the cellulose into cellulose nitrate ($C_6H_9O_5(NO_2)$, $C_6H_8O_5(NO_2)_2$ or $C_6H_7O_5(NO_2)_3$); 4) subjecting the NC to an acidic boiling step; 5) refining the NC, wherein the NC is chopped into smaller pieces; 6) poaching the NC smaller pieces; 7) screening the poached smaller pieces, wherein clumps and unsatisfactory material are removed; 8) blending the screened NC with other batches of poached and screened NC; 9) dewatering the blended NC, wherein water is removed, typically via centrifuging; and 10) dehydrating the centrifuged NC to remove water from the NC, wherein the water wet NC is loaded into a blocking press and compressed into a block, thereby forcing water out via pressure, and, thereafter, alcohol may be injected into the block under pressure to displace remaining water, after which, a densely formed block of NC is formed. The blocked NC may be stored for future use. When NC is requested or ordered for propellant production, the NC block, which is not usable in block form, is then subjected to a block breaking step, wherein the large dense block of NC is broken into smaller chunks that can be managed by a mixer. If the particular propellant production requires an NC/NG starting material, NG material is added to the smaller pieces of the NC prior to forwarding.

The propellant production process typically includes, in order, the steps of 1) acquiring the NC material (NC/NG starting material for double-base propellants); 2) propellant mixing, wherein the acquired NC starting material is mixed with various ingredients desired in the final propellant product to form a propellant mixture, for example, stabilizers, flash suppressant, de-coppering agent and rat/burn modifiers; 3) blocking, wherein the propellant mixture is compressed, effecting a removal of air; 4) extruding and cutting, wherein the blocked propellant mixture is then extruded and cut to produce propellant grains; 5) deterrent coating, wherein the grains coated with a deterrent; 6) drying the grains; 7) screening, wherein unsatisfactory grains are removed; 8) batching, wherein the screened grains are mixed with other lots of the same types of grains; and 9) blending and packing, wherein the batched grains are blended with grains of differing types and packaged for storage or delivery of the produced propellant.

In an alternative to the above propellant production process, prior methods include using a process known as the ball propellant process. In the manufacturing of ball propellant, nitrocellulose is dissolved in ethyl acetate containing small quantities of desired stabilizers and other additives. The resultant syrup, combined with water and surfactants, is heated and agitated in a pressurized container until the syrup forms an emulsion of small spherical globules of the desired size. Ethyl acetate distills off as pressure is slowly reduced to leave small spheres of nitrocellulose and additives. The spheres can be subsequently modified by adding nitroglycerin to increase energy, flattening between rollers to a uniform minimum dimension, coating with deterrents to retard ignition, and/or glazing with graphite to improve flow characteristics during blending.

Operations for the NC production process and the propellant production process are separated by a certain distance known as the quantity distance arc, which is dictated by Ammunition and Explosives Safety Standards. This is required to assure that any ignition issues with the energetic components are not transitioned to the next or neighbor operation. Since propellant extrusion operations are generally performed with unattended batch operations and screw extruders specially adapted for extrusion of energetic materials, the cost to operate is very high relative to the processing of inert materials.

The above methods of NC based propellant production, including the NC production process and the propellant production process, are complex, requiring numerous processing steps and separation of operations, labor intensive and require substantive time and expense. Examples of further prior methods of preparing cellulose material as a propellant component further include those disclosed in:

U.S. Pat. No. 1,590,598, issued to Taylor, which relates to a method of making smokeless powder from organic material including cotton and carbohydrates, such as starch.

U.S. Pat. No. 1,590,594, issued to Taylor, relates to the treatment and conversion of cellulose or cellulosic materials, including cotton and mixtures of silk and cotton.

U.S. Pat. No. 3,218,907, issued to Beal, relates to felted combustible cartridge cases and a process for the preparation of the same.

US Patent Publication 20060180253 relates to a method for manufacturing microcrystalline nitrocellulose to provide an energetic, nitrogen fuel.

Such further methods do not produce particular particle sized and shaped cellulose based propellants having acceptable thermal stability and ultimate nitrogen substitution ranges that are useful to the small arms industry.

To be useful to the small arms industry, it is desirable that cellulose based propellants exhibit acceptable thermal stability and have ultimate nitrogen substitution ranges. Stabilization of propellant material is required to produce propellants that have sufficiently long shelf lives and remain useful. Basic components of smokeless propellants, for example nitroglycerin and nitrocellulose, undergo decomposition under natural aging conditions. The main decomposition products are nitrogen oxides that are a catalyzer of further accelerated decomposition. To prevent autocatalytic decomposition of nitroglycerine or nitrocellulose, substances that react very fast with nitrogen oxides, e.g. stabilizers, having typically been added to propellants. Stabilizers, in a way "absorb" the catalyzer that results in an increase in chemical stability of propellants. Thus a basic safety condition for propellant (ammunition) storage is a control of its stability on a regular basis. As such, propellants are tested against established standards for their chemical stability.

Due to the energetic nature of such propellants and the high expectations of safety and performance, the processes for producing and the standards for storage and performance of NC are highly scrutinized and standardized. Military standards require specific processing and performance requirements for propellants, such as nitrocellulose propellant. NC must pass the stability requirements of MIL-DTL-244B and more specifically the requirements of MIL-STD-286C, Method 404.1.2. MIL-DTL-244B is included in the U.S. military DETAIL SPECIFICATION: NITROCELLULOSE, which covers the requirements, examinations and tests for five grades, four types, and two classes of nitrocellulose for use in propellant, and MIL-STD-286C is included in the MILITARY STANDARD: PROPELLANTS, SOLID: SAMPLING, EXAMINATION AND TESTING, which describes the general methods of sampling, examining, and testing solid propellants.

The above mentioned MIL-STD-286C of MILITARY STANDARD PROPELLANTS, SOLID: SAMPLING, EXAMINATION AND TESTING, Method 404.1.2, also referred to as the German Test, includes stability requirements and protocols that samples of NC must pass to meet military standards. In this test, a dried NC sample is added to the bottom of a special test tube with a piece of Methyl Violet test paper suspended above the NC sample. The test tube is immersed in a heated bath at 134.5° C. and to be considered thermally stable the test paper cannot completely turned salmon pink until 30 minutes have passed. In Method 404.1.2 (Heat Tests (120 and 135.5 C)), Procedure section 4.6, the tester is instructed to test the nitrocellulose specimens by examining the test paper after the first 20 minutes, and thereafter at 5 minute intervals, and discontinue the test when the salmon pink end point is attained in any of the papers, then recording the test time. However, it is further stated in section 4.6 that if the violet paper is not completely changed in 25 minutes, but is completely changed in 30 minutes, the tester is to record the time of the test as 30 minutes. As such, samples that have not completely changed in 25 minutes, but do so prior to the 30 minute mark, are deemed to have passed, even though they have not achieved the full 30 minutes in the stability test.

Prior methods fail to offer NC based propellant production processes that allow for consolidated and concentrated nitrocellulose and propellant production processes at a single location and that include fewer processing steps, requiring less time and expense, and that also result in NC propellant exhibiting complete stabilization.

It would be desirable to provide consolidated and concentrated low cost processes that produce particular particle sized cellulose based propellants having acceptable thermal stability and ultimate nitrogen substitution ranges that are useful to the small arms industry. It would further be desirable to provide methods of production of useful propellants of pre-shaped particles of various sizes and shapes which have high nitration substitution and complete stabilization so as to exhibit sufficiently long shelf life. It would further be desirable to provide such methods which utilize a wide range of starting materials, such as materials differing in composition, shape, size and surface area. It would be further desirable that those propellants survive the necessary mechanical stresses, such as high rate impact and high strain rate environment inside a gun cartridge during ignition and combustion.

The above patents and patent publications are herein incorporated by reference in their entireties. The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 CFR § 1.56(a) exists.

SUMMARY

The present disclosure includes methods of production of nitrocellulose based propellants for small firearms and propellant products made therefrom. In some embodiment, the methods of production include nitrating pre-shaped cellulose particles and thereafter stabilizing the pre-shaped particles using a series of boiling regimens. The shape of the cellulose material is maintained throughout the production of the propellant. Resulting nitrocellulose particles of the produced propellants reliably exhibit complete stabilization, ultimate nitrogen substitution ranges, and are useful in the small firearm industry. Sizes and shapes of the nitrocellulose particles in the final propellant can vary and can also be predetermined and preprogrammed prior to nitration in accordance with the desired final product.

In some embodiments, the methods include preparing and providing shaped particles comprising cellulose material, wherein the particles are shaped consistent with a desired final propellant product shape; thereafter nitrating the particles to form nitrocellulose particles; and thereafter stabilizing the shaped nitrocellulose particles using a series of boiling regimens. The stabilized nitrocellulose particles can then be further processed consistent with the composition of the desired propellant.

In some embodiments, the present invention is directed toward propellant for use in power loads and/or small arms cartridges and methods for preparing such propellants. In at least some embodiments, the propellant comprises energetic particles, wherein the energetic particles are nitrocellulose particles having a final shape. In at least some embodiments, the method of preparing the propellant comprises the steps of: providing an amount of cellulose particles. The cellulose particles are pre-shaped, such that they have the final shape of the nitrocellulose particles. The cellulose particles further have a cross-section length of at least 50 microns. The cellulose particles are then nitrated sufficiently to produce nitrocellulose particles having at least 12% nitrogen.

Thereafter, the method includes stabilizing the nitrocellulose particles by a series of boiling regimens. The stabilizing comprises the steps of: subjecting the nitrocellulose particles to an acid boil regimen comprising boiling the nitrocellulose particles in an acid boil solution comprising substantially water at an elevated temperature of at least 115° C. for a period of no more than 30 hours; thereafter subjecting the nitrocellulose particles to a first neutral boiling of the nitrocellulose particles in a first neutral solution of substantially water for a period of time; and thereafter subjecting the nitrocellulose particles to a first alkaline boiling of the nitrocellulose particles in a first alkaline solution of substantially water for a period of time. The nitrocellulose particles are thereby completely stabilized and wherein the nitrocellulose particles exhibit complete nitration. The combined period of time of the neutral boiling and the alkaline boiling can be less than 30 hours. Thereafter, the particles are dried. The resulting nitrocellulose particles form the energetic particles of the propellant and the shapes of the cellulose particles are substantially maintained in the propellant without any plasticination added to the preshaped cellulose particles.

In at least some embodiments, stabilizing is limited to the acid, neutral and alkaline regimens, the boiling temperature is at least 115° C. and the neutral regimen and the alkaline regimen have a combined duration of less than 25 hours. In further embodiments, the acid boil regimen, the neutral regimen and the alkaline regimen have a combined duration of less than 45 hours.

In at least some embodiments, the stabilizing is limited to the acid, neutral and alkaline regimens, the boiling temperature is at least 130° C., the acid boil duration is no more than 15 hours and the neutral regimen and the alkaline regimen have a combined duration of less than 20 hours. In further embodiments, the acid boil regimen, the neutral regimen and the alkaline regimen have a combined duration of less than 30 hours. In still further embodiments, the boiling temperature is at least 130° C., the acid boil duration is no more than 10 hours and the neutral regimen and the alkaline regimen have a combined duration of less than 20 hours. The acid boil regimen, the neutral regimen and the alkaline regimen have a combined duration of less than 25 hours.

In these and other exemplary embodiments, the stabilized nitrocellulose particles in the propellant comprise at least 12.5% nitrogen; have a chemical stabilizer concentration of 2.0 wt % or less; and, in cross-section, have a felted and/or non-plasticized appearance. In some embodiments, the nitrocellulose particles can further comprise nitroglycerin and/or further additives.

The formed nitrocellulose particle can be packaged and shipped to a customer for use or incorporation into cartridges in a cartridge manufacturing process. Such cartridges can include, but are not limited to power load cartridges and small-arms cartridges.

At least some embodiments of the current disclosure include a method for preparing a propellant having energetic particles for use in small arms cartridges. The energetic particles comprise nitrocellulose and have a shape and size. In the method, an amount of cellulose particles is prepared or obtained. The cellulose particles are pre-shaped, or obtained as such, such that the shape of the cellulose particles are the same as the shape of the energetic particles desired propellant. The cellulose particles are sized such that they include a cross-section length of at least 50 microns. Thereafter, the cellulose particles are nitrated to an extent sufficient to produce nitrocellulose particles having at least 12% nitrogen. The nitrocellulose particles are then completely stabilized by a series of boiling regimens, including subjecting the nitrocellulose particles to an acid boil regimen, and thereafter an organic solvent solution boil regimen and an alkaline boil regimen. Thereafter, the nitrocellulose particles are subjected to a drying step and combined with one or more propellant components consistent with the desired final propellant. In the final propellant, the nitrocellulose particles form the energetic particles of the propellant and the shapes of the cellulose particles are substantially maintained in the propellant without any plasticination added to the preshaped cellulose particles.

In the method, the acid boil regimen comprises boiling the nitrocellulose particles in an acid boil solution, which is substantially water, for an amount of time. The organic solvent solution boil regimen can comprise a first boiling of the nitrocellulose particles in a first organic solvent solution for a period of time and, thereafter, a second boiling of the nitrocellulose particles in a second organic solvent solution for a period of time. In some embodiments, the organic solvent solutions comprise ethanol. The alkaline boil regimen comprises a first boiling of the nitrocellulose particles in a first alkaline solution for a period of time, wherein the first alkaline solution comprises substantially water.

In some embodiments, the solvent solution boil regimen further comprises a third organic solvent boiling of the nitrocellulose particles in a third organic solvent solution, which comprises ethanol, for a period of time. In a further aspect, the alkaline boil regimen can be after the solvent boil regiment and can further comprises a second alkaline boiling of the nitrocellulose particles in a second alkaline solution, which comprises substantially water, for a period of time.

The organic solvent solutions of the organic solvent solution boil regimens, in accordance with some embodiments, can have an ethanol content of 20 to 100 percent, and in some, 20 to 50 percent. In some embodiments, the alkaline solutions can comprise an amount of weak base in an effective amount to neutralize leaching remnant acid and to neutralize the outer surface of the nitrocellulose particles.

The step of stabilizing the nitrocellulose particles can further comprise subjecting the nitrocellulose particles to a neutral boil regimen. The neutral boil regimen can comprise a first neutral boiling of the nitrocellulose particles in a first neutral solution, which substantially comprises water, for a period of time. In some embodiments, the neutral boil regimen can be performed between the acid boil regimen and the solvent solution boil regimen. In some embodiments, the neutral boil regimen can further comprise a second neutral boiling of the nitrocellulose particles in a second neutral solution, which comprises substantially water, for a period of time.

After the step of stabilizing the nitrocellulose particles, in some embodiments the method can further comprise the step of impregnating the nitrocellulose particles with a chemical stabilizer. The impregnating comprises mixing the nitrocellulose particles in a chemical stabilizer solution comprising the chemical stabilizer. In some embodiments, the nitrocellulose particles are impregnated to have a chemical stabilizer concentration of 5.0 wt % or less. In some embodiments, they are impregnated to have a chemical stabilizer concentration of 2.0 wt % or less. In some embodiments, they are impregnated to have a chemical stabilizer concentration of 0.5 wt % or less. In some embodiments, the nitrocellulose particles can be free of a chemical stabilizer.

After the step of stabilizing the nitrocellulose particles, in some embodiments the method can also comprise impregnating the nitrocellulose particles with nitroglycerine to make the propellant a double base propellant. The nitroglycerine impregnation can comprise adding the nitrocellulose particles to a mixing solution; heating the mixing solution; and adding a nitroglycerin solution to the mixing solution. The mixing solution can be mixed for a period of time to effectuate the impregnation.

After the stabilizing step, and, in some embodiments, after the drying step, the method can further include a batching step, according to some embodiments. Batching involves mixing the particles with other lots of the same or similar types of particles to provide uniformity in the final propellant product.

In some embodiments, the propellant can be combined with various propellant components, including particular coatings and additives. Such components can be incorporated, in some embodiments, by way of the step of combining the nitrocellulose particles with one or more propellant components. The step, in accordance with some embodiments, comprises mixing nitrocellulose particles with one or more propellant components, including, as examples, deterrents, flash suppressors, opacifiers, surfactants, oxidizers, ballistic modifiers, de-coppering agents, and combinations thereof. The mixing can be done by tumbling the nitrocellulose particles with one or more propellant components and, in some embodiment, the mixing can be done in solution. In accordance with some embodiments, the nitrocellulose particles can be mixed, in solution, with an amount of deterrent for a period of time.

After the step of combining the nitrocellulose particles with one or more propellant components, in some embodiments, the method can further comprise the step of blending the nitrocellulose particles with particles of differing types that are included in the final propellant.

The nitrocellulose particles, in accordance with some method embodiments, are completely stabilized by way of the step of stabilizing the nitrocellulose particles by a series of boiling regimens. The nitrocellulose particles are completely stabilized in that they are considered stabilized consistent with the military standardization requirements defined in MIL-SPEC-286C method 404.1.2 and have a German Test time of at least 30 minutes (actual). In some embodiments, the nitrocellulose particles have a German Test time of at least 32 minutes (actual). The subjecting of the nitrocellulose particles to an organic solvent solution boil regimen, in accordance with some embodiments, effectuates a swelling of the nitrocellulose particles, leaching entrapped acid and allowing it to be removed. In some embodiments, the nitrocellulose particles can exhibit no traces of acid.

The series of boiling regimens comprise a plurality of boilings, each lasting a period or an amount of time. In some embodiments, the solvent boil periods of time can comprise durations of 1 to 10 hours, and in some embodiments 3 to 7 hours. In some embodiments, the alkaline boil periods of time can comprise durations of 1 to 10 hours, and in some embodiments 2 to 6 hours. In some embodiments, the neutral boil periods of time can comprise durations of 1 to 10 hours, and in some embodiments 3 to 7 hours. In some embodiments, the amount of time of the acid boil regimen is no more than 140 hours, and in some embodiments no more than 96 hours. The acid boil regimen, in accordance with some embodiments, can be performed in a closed vessel under pressure at a temperature above 100° C. In such a case, the amount of time of the acid boil regimen can be no more than 10 hours.

In some embodiments, the step of nitrating the cellulose particles to produce nitrocellulose particles can comprise reacting the cellulose particles with a nitrating agent or acid mixture in solution. The nitrocellulose particles, in accordance with some embodiments, are nitrated to an extent such that the nitrocellulose particles exhibit complete nitration. In some embodiments, the cellulose particles can be nitrated to an extent sufficient to produce nitrocellulose particles having at least 13% nitrogen, and in some embodiments at least 13.5% nitrogen. In accordance with some embodiments, the cellulose particles are nitrated for 8 hours or less.

The method, in accordance with some embodiments, can further comprise the step of predetermining the sizes and shapes of the energetic particles. As the size and shape of the cellulose comprising particles does not substantively change in the production of the propellant, in accordance with some method embodiments, the sizes and shapes of the nitrocellulose particles in the final propellant can also predetermined and pre-shaped prior to nitration.

In accordance with some embodiments, the method provides flexibility and can utilize various cellulose comprising materials from various sources for the cellulose particles. The obtained cellulose material can, in accordance with some embodiments, be shaped into varying sizes and shapes, using various methods; then nitrated to exhibit complete nitration and a high nitration concentration; and thereafter stabilized to complete stabilization. In some embodiments, the nitrocellulose particles maintain their sizes and shape in the final propellant.

In some embodiments, the cellulose particles can have sizes that include a cross-section length in varying ranges, including, as examples: at least 100 microns; at least 200 microns; at least 500 microns; 50 microns to 1 mm; 100 microns to 1 mm; 200 microns to 1 mm; 300 microns to 1 mm; 500 microns to 1 mm; and 1 nm to 5 mm. In accordance with some embodiments, the cellulose particle shapes can also be varied, including, for example, such shapes as: spheres, cylinders, granules, pellets and disks. In some embodiments, the shapes of the cellulose particles can be disks and comprises one or more perforations.

In at least some embodiments, the methods of prepare propellant product disclosed herein are continuous and consolidated, excluding certain traditional steps, comprising fewer steps and requiring less time, labor and equipment relative to traditional methods. Flexibility in starting material provided by the present methods further allows for lower material costs and a wider range of available shapes and sizes. As a result, propellant products of the present invention and those products incorporating or using such propellant products can be offered at lower cost as compared to traditional methods.

In some embodiments, the propellant can be further packaged and provided to users. In some embodiments, the propellant can be incorporated and/or provided for incorporation into cartridges for small arms, such as, for example, rifles, handguns, shotguns and machine guns. In some embodiments, the propellant can be package and/or provided for use in reloading applications, such as propellant for muzzle loading projectiles.

The above summary of the various representative aspects of the disclosure is not intended to describe each illustrated aspect or every implementation of the disclosure. Rather, the aspects are chosen and described so that others skilled in the art can appreciate and understand the principles and practices of the disclosure. The figures in the detailed description that follow more particularly exemplify these aspects.

Still other objects and advantages of the present disclosure and methods of construction of the same will become readily apparent to those skilled in the art from the following detailed description, wherein only the preferred embodiments are shown and described, simply by way of illustration of the best mode contemplated of carrying out the disclosure. As will be realized, the disclosure is capable of other and different embodiments and methods of construction, and its several details are capable of modification in various obvious respects, all without departing from the disclosure. Accordingly, the drawing and description are to be regarded as illustrative in nature, and not as restrictive.

BRIEF DESCRIPTION OF THE DRAWINGS

The disclosure can be understood in consideration of the following detailed description of various aspects of the disclosure in connection with the accompanying drawings, in which.

Figure 1:
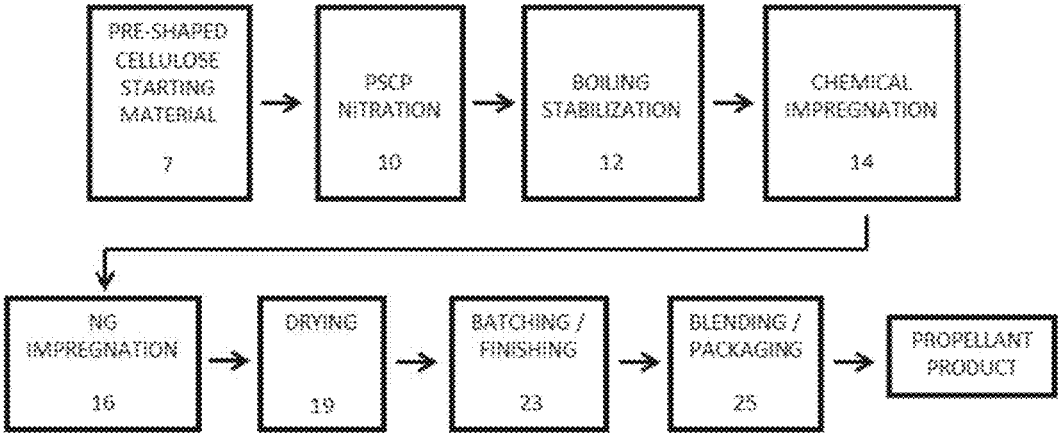
FIG. 1 is a block flow diagram of a propellant production process in accordance with an embodiment of the invention.

While the present disclosure is amenable to various modifications and alternative forms, specifics thereof have been shown by way of example in the drawings and will be described in detail. It should be understood, however, that the intention is not to limit the present disclosure to the particular aspects described. On the contrary, the intention is to cover all modifications, equivalents, and alternatives falling within the spirit and scope of the present disclosure as defined by the appended claims.

DETAILED DESCRIPTION

While this disclosure may be embodied in many different forms, there are described in detail herein specific embodiments of the disclosure. This description is an exemplification of the principles of the disclosure and is not intended to limit the disclosure to the particular embodiments illustrated.

For the purposes of this disclosure, like reference numerals in the figures shall refer to like features unless otherwise indicated.

Included herein are methods of making NC propellant compositions for firearms that include preparing and providing particles comprising cellulose starting material, shaped consistent with a desired final propellant product shape, and thereafter nitrating and stabilizing the pre-shaped cellulose particles using certain boiling stabilization processes. The stabilized pre-shaped NC particles can then be further processed as desired. The resulting nitrocellulose propellants of the methods reliably exhibit complete stabilization and acceptable shelf life, high nitrogen substitution, and acceptable ballistic performance.

Propellant Production Process:

Turning to the figures, FIG. 1 is a block flow diagram generally illustrating a method of production of an NC based propellant in accordance with some embodiments of the disclosure. A first step 7 of the method, labeled Pre-Shaped Cellulose Starting Material, can be the preparation and providing of a plurality of shaped particles comprising a cellulose starting material (pre-shaped cellulose particles or cellulose particles). As illustrated in FIG. 1, the pre-shaped cellulose particles are subjected to a nitration process step 10 (labeled PSCP Nitration"). In this process, the cellulose particles are nitrated to produce pre-shaped nitrocellulose particles or NC particles. The NC particles are then subjected to a boiling stabilization process step 12 comprising a regime of particular boiling steps. The NC particles are completely stabilized, meaning they are considered stabilized consistent with the military standardization requirements defined in MIL-SPEC-286C method 404.1.2 and have a German Test time of at least 30 minutes (actual). According the desired end product, the NC particles can then be subjected to a chemical impregnations step 14, which can include stabilizer impregnation, and an NG impregnation step 16, which can be incorporated to prepare double based propellant. The resulting NC or NC/NG particles can then be subjected to a drying step 19, then a batching/finishing step 23, which can include a deterrent coating process, and then a blending/propellant packaging step 25. The resulting propellant is then made available to customers or used to process projectiles, such as small arm cartridges.

It is within the disclosure of present invention scale to production quantities to accommodate smaller or larger product requirements, for example larger scale manufacturing. As such, the present invention shall not be limited to the scale of the examples and illustrations disclosed herein.

Pre-Shaped Cellulose Starting Material:

In the first step 7, cellulose starting material can be reduced to particles, wherein the particles are shaped to form a plurality of pre-shaped cellulose particles (also referred to as "cellulose particles" or "PSCP"). The size and shape of the pre-shaped cellulose particles are predetermined based on the shape and size of the desired end product and use. Pre-shaped cellulose material can be produced and shaped by a number of different processes including, but not limited to: extrusion and cutting with a press or multiple screw extruder, and atomization, wherein the cellulose starting material is sprayed into the air to form droplets. The cellulose starting material can further be acquired pre-shaped from conventional commercial cellulose producers or as a byproduct (waste) of various manufacturing processes, for example waste from alcohol manufacturers.

PSCP Nitration:

In a second step 10 (PSCP Nitration) of an embodiment of the disclosure, the pre-shaped cellulose particles can then be nitrated. In the nitration process step 10, the cellulose particles are mixed with a nitrating acid or agent, which can be a nitrating acid solution of concentrated acid or acid mixture to produce pre-shaped NC particles. As a general example, the nitrating agent can be a concentrated solution of $HNO_3$. When $HNO_3$ is used, during the resulting chemical process, the nitric acid converts the cellulose into cellulose nitrate, having the chemical formula of $C_6H_9O_5(NO_2)$, $C_6H_8O_5(NO_2)_2$ or $C_6H_7O_5(NO_2)_3$, depending on the degree of nitration. As a further example, the nitrating agent can be a concentrated solution of a mixture of acids, such as sulfuric acid and nitric acid. The sulfuric acid can be used in conjunction with the nitric acid during the nitrating process to prevent the water produced in the reaction from diluting the concentration of nitric acid. Further examples of nitrating acids or agents are described below.

Figure 2:
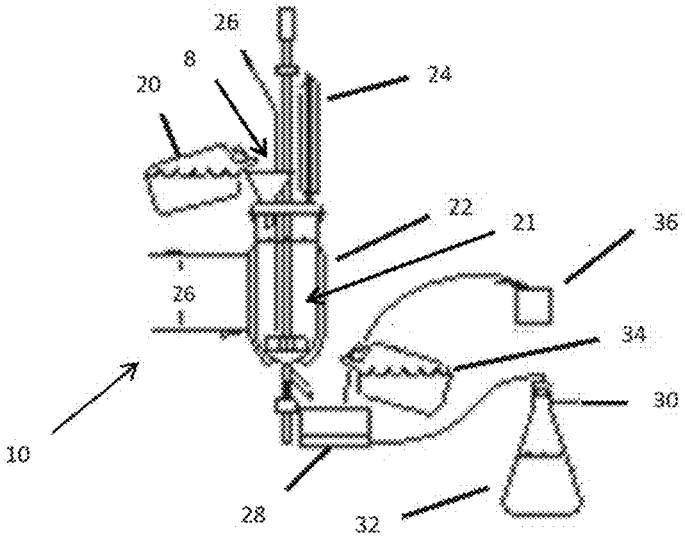
FIG. 2 is a flow diagram of a nitration process in accordance with an embodiment of the invention.

FIG. 2 shows a side view schematic of a non-limiting example of the nitration process step 10. In the example, a nitrating acid solution 20 is prepared and can be added into a reactor 22, which can incorporate a condenser 24. As illustrated in FIG. 2, the cellulose particles 8 can be added and combined with the nitrating acid solution 20 to produce a cellulose acid mixture 21. The cellulose acid mixture 21 can be agitated in the reactor 22, nitrating the cellulose particles 8 to produce pre-shaped NC particles or NC particles that have maintained their pre-shaped form. The nitrated cellulose acid mixture 21 is then filtered 28, which can be done under vacuum 30, so as to isolate the NC particles and remove the spent acid 32. The filtered NC particles can then be quenched, which can be done with cold water 34. In some embodiments, the NC particles can be deluged with water immediately to prevent denitration. The resulting NC particles 36, which can remain in a quantity of water and form a slurry, are then removed.

Examples of nitration process step 10 conditions can include, but are not limited to: the nitrating acid to cellulose weight ratio in some embodiments can be between 15:1 and 40:1; in some embodiments it can be between 18:1 and 30:1; and in some embodiments between about 18:1 and 25:1. In some embodiments, the temperature 26 can be maintained in the range of about 0° C. to 55° C., about 15° C. to 55° C., or about 25° C. to 40° C. In some embodiments, reaction time can be in the range of about 5 min to 48 hours, about 30 minutes to 8 hours, or about 1 to 4 hours. In some embodiments, the amount of quenching water can be at least 2 times as much cold water as the amount of nitrating acid used to nitrate the cellulose and the rinsing water can be less than 15° C.

In at least some embodiments, multiple reactors can be used to nitrate multiple batches contemporaneously. After nitration, the multiple batches can be combined for the Boiling Stabilization step.

Figure 3:
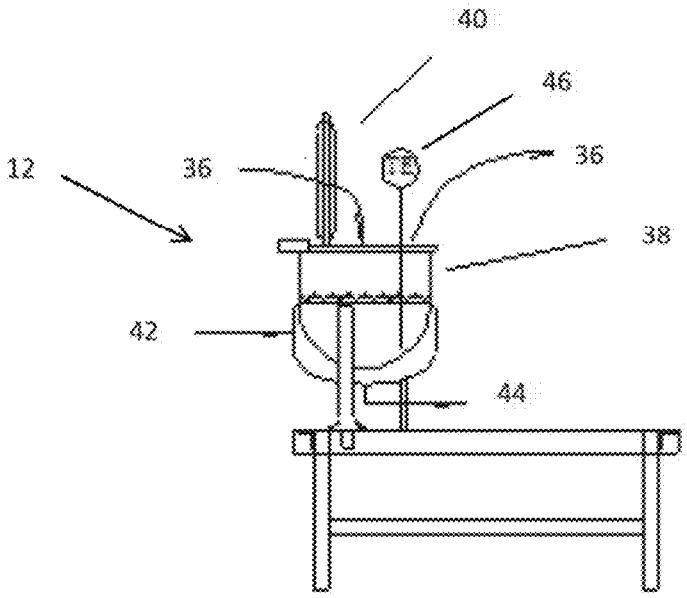
FIG. 3 is a flow diagram of a boiling stabilization process in accordance with an embodiment of the invention.

Boiling Stabilization:

The NC particles can then be subjected to a boiling stabilization process step 12, wherein the NC particles are stabilized through a series of washes and boils in water and organic solvent solution. FIG. 3 is a side view schematic of a non-limiting example of the boiling stabilization process step 12. The boiling stabilization process step 12 can utilize conventional boiling and condensing equipment, which can include a kettle 38, a condenser 40, a containment assembly 42 for steam containment and collection of condensate 44, and a temperature indicator 46.

The boiling stabilization process step 12 comprises multiple boiling steps of the NC particles 36 under a plurality of conditions. The multiple boiling steps comprise an acid boil regimen and an organic solvent solution boil regimen. The multiple boiling steps can further comprise a neutral boil regimen and an alkaline boil regimen.

Acid Boil Regimen:

The acid boil regimen consists of boiling the NC particles in a water solution for a period of time that effectuates the removal of at least a portion of acid that remains within the NC particles from the nitrating step. As an example, the conditions of the acid boil can include, but are not limited to, boiling the NC particles for a duration of time that can be: 1 to 96 hours; in some embodiments, 60 to 96 hours; and, in some embodiments, about 70 hours. The boiling stabilization process step can further comprise no more than one acid boiling period, which can comprise of no more than about 140 hours. As an example, the ratio of the weight of water to NC particles can be about 2:1 to about 15:1, in some embodiments about 8:1 to about 15:1, and in some embodiments about 13:1; about 7:1; or about 3-4:1. The temperature of the water solution can be boiling temperature or at least about 95° C.

In some embodiments, boiling period(s) of the acid boiling regimen are conducted in a closed pressurizable vessel, wherein the temperature is increased, resulting in an increase in pressure and an increase in the boiling point of the boiling solution. The boiling period(s) are conducted by heating the vessel and bringing the water solution containing the NC up to a boiling temperature and substantially maintaining the boiling temperature for the boiling period duration. After the acid boil period, the vessel is drained and can be used in the subsequent boiling steps. In some embodiments of the invention, the stabilization process step can comprises no more than one acid boiling period.

In these and other various embodiments, the boiling temperature of the acid boil period can be: 100° C. to 140° C.; 110° C. to 135° C.; at least about 115° C.; 115° C. to 130° C.; about 115° C.; or about 130° C. In these and other various embodiments, the duration of the acid boil period can be: at least 5 hours; 30 hours or less; 25 hours or less; 15 hours or less; 10 hours or less; 5 to 30 hours; 5 to 25 hours; 15 to 25 hours; 5 to 15 hours; 5 to 10 hours; about 24 hours; about 12 hours; or about 8 hours.

As the temperature of the vessel is brought up to the boiling temperature and through the duration, the inner pressure of the vessel can increase. The vessel may contain a release valve to prevent over pressurization and to regulate the temperature. Examples of pressure ranges over the duration of the period include: 20-30 psig to 30-40 psig; 25-40 psig to 65-75 psig; 25-40 psig to 85-95 psig; 24-25 psig to 33-36 psig; 35-36 psig to 68-69 psig; and 30-33 psig to 88-90 psig.

Although embodiments include combinations of the above, examples of combinations of the A) boiling temperature and the B) duration of the boiling period can include: A) 100° C. to 140° C. and B) at least 5 hours, 30 hours or less, 25 hours or less, or 15 hours or less; A) 110° C. to 135° C. and B) at least 5 hours, 30 hours or less, or 5 to 25 hours; A) at least about 115° C. and B) at least 5 hours, 30 hours or less, 15 to 25 hours, about 24 hours or less, about 12 hours or less, or about 8 hours or less; A) 115° C. to 130° C. and B) at least 5 hours, 30 hours or less, or 5 to 15 hours; A) about 115° C. and B) at least 5 hours, 30 hours or less, or 15 to 25 hours; and A) 130° C. and B) at least 5 hours, 30 hours or less, 5 to 15 hours or 5 to 10 hours. Exemplary embodiments further include combinations of these and the above weight ratios and pressure ranges noted above In at least one embodiment, the acid boiling regimen is conducted in a closed vessel and comprises one period of 1-30 hours. In these and other various embodiments the temperature for the acid boiling period is set at 115° C. or more and the pressure can rise above 24 psig. In some embodiments, the acid the temperature for the acid boiling period is set at 130° C. or more and the pressure can rise above 36 psig.

In at least some embodiments, the boiling stabilization process step comprises one period of acid boiling at an elevated temperature and pressure, including the combinations noted above, but excludes any organic solvent solution boiling periods. In these and other various embodiments, the resulting NC exhibits complete stabilization and nitration.

Neutral Boil Regimen:

The neutral boil regimen comprises boiling the NC particles in a water solution for a period of time. In some embodiments, the NC particles can be subjected to one or more boiling periods. Examples of duration of a neutral boiling period according to some embodiments of the disclosure include 1 to 10 hours; 3 to 7 hours; about 9-10 hours; and about 5 hours. In some embodiments of the neutral boil regimen, two neutral boiling periods can be performed, and in some embodiments two neutral boiling periods with durations of about 5 hours. Temperatures can be maintained at about boiling temperature or at least 95° C. As an example, in some embodiments, the ratio of the weight of water to the weight of NC can be about 2:1 to 15:1, in some embodiments about 8:1 to 15:1, and in some embodiments about 13:1, about 7:1 or about 3-4:1. In some embodiments, the water solution pH can be less than 7.

Organic Solvent Solution Boil Regimen:

The organic solvent solution boil regimen comprises boiling the NC in an organic solvent solution, an example of which is an ethanol ("EtOH") solution, for a period of time and temperature that effectuates a removal of entrapped acid from the NC particles so as to allow for stabilization of the NC particles. The organic solvent solution boil regimen brings about a swelling of the NC particles, leaching entrapped acid, allowing it to be removed. The thorough release of entrapped and residual acid increases the stabilization of the NC particles and can further improve the addition of stabilizer additives.

In some embodiments, the organic solvent solution boil regimen can comprise one to at least three organic solvent solution boiling periods. As a non-limiting example, duration of an organic solvent solution boiling period can be 1 to 10 hours and in some embodiments the duration can be 3 to 7 hours and in some embodiments about 5 hours. In some embodiments of the organic solvent solution boil regimen, two organic solvent solution boiling periods can be performed with durations of about 5 hours. In further embodiments of the organic solvent solution boil regimen, three organic solvent solution boiling periods can be performed with durations of about 5 hours. Temperatures can be maintained at about boiling temperature or about 77° C. As a non-limiting example, the ratio of the weight of organic solvent solution to the weight of NC can be between 2:1 and 15:1, in some embodiments between 8:1 and 15:1, and in some embodiments about 13:1, about 7:1, or about 3-4:1.

Organic solvent solutions include solutions that comprise organic solvents that are miscible with water and that swell, but do not dissolve NC to any appreciable extent. Examples of organic solvents include, but are not limited to, ethanol ("EtOH"), isopropanol, methanol; N-Butanol, methyl t, butyl ether, and mixtures thereof. Examples of the organic solvent solution according to some embodiments of the disclosure include solutions comprising at least 20% organic solvent in water to about 100% organic solvent; 20-50% organic solvent in water; and about 25% organic solvent in water. Further examples include solutions comprising at least 20% EtOH in water; 20-50% EtOH in water; and about 25% EtOH in water. A further example includes 93% EtOH, 1% Toluene and 6% water. In some embodiments, the NC can be wet when added, for example about 30% wet.

Alkaline Boil Regimen:

The alkaline boil regimen comprises boiling the NC particles in a water solution for a period of time. In some embodiments, the NC particles can be subjected to one or more boiling periods. The water solution can further comprise a weak base substance, which can be included at about 0.005 g to about 0.01 g of weak base per gram of NC or in the amount of about 0.4 g/l. An example of a weak base substance can be soda ash. The base can be used to neutralize leaching remnant acid and to neutralize the surface of the particles.

Examples of duration of an alkaline boiling period according to some embodiments of the disclosure include 1 to 10 hours; 2 to 6 hours; 9-10 hours; and about 4-5 hours. In some embodiments of the alkaline boil regimen, two alkaline boiling periods can be performed, and in some embodiments two boiling periods with durations of 4 hours. Temperatures can be maintained at about boiling temperature or at least 95° C. As an example, in some embodiments, the ratio of the weight of water to the weight of NC can be between 2:1 and 15:1, in some embodiments between 8:1 and 15:1, and in some embodiments about 13:1, about 7:1, or about 3-4:1. In some embodiments, the water solution pH can be greater than 5; and in some greater than 7.

Boiling Stabilization Examples:

Some embodiments of the boiling stabilization process step 12 in accordance with the disclosure include varying combinations of the acid, organic solvent solution, neutral and alkaline boiling regimes and the varying boiling period parameters therein. In theses and various other embodiments, one to all of the boiling regimens can be conducted in the same vessels. Further, the vessel(s) can be a closed vessel and one to all of the boiling regimens can be conducted under pressure and at elevated temperatures.

A non-limiting example of the boiling stabilization process step 12 can comprise an acid boiling regimen, which includes an acid boiling period, followed by an organic solvent solution boiling regimen, which includes a first organic solvent solution boiling period. In a variation of the example, the organic solvent solution boiling regimen can further include a second organic solvent solution boiling period and, in a further variation, a third organic solvent solution boiling period.

In further variations, the above examples can further comprise an alkaline boil regimen after the acid boil regimen. The alkaline boil regimen can comprise a first alkaline boiling period and can further comprise a second alkaline boiling period. The alkaline boil regimen can further be prior to or after the organic solvent solution boil regimen.

In further variations, the above examples can further comprise a neutral boil regimen after the acid boil regimen. The neutral boil regimen can comprise a first neutral boiling period. The neutral boil regimen can further be before the organic solvent solution boil regimen.

Conditions and formulations for the above example variations can include, all, any or combinations of the following: the duration of the acid boiling period can be no more than 140 hours or can be about 70 hours; the ratio of the weight of water to the weight of NC in the acid boil can be about 2:1 to 15:1; the organic solvent solution is an ethanol solution; the ethanol solution can have at least 25% EtOH; the organic solvent solution regimen can comprise at least two periods; the organic solvent solution boiling periods have durations of 1 to 10 hours or about 5 hours; the ratio of the weight of ethanol solution to the weight of NC can be about 2:1 to 15:1; the first neutral boiling period is included; the first neutral boiling period can have a duration of about 1 to 10 hours or about 5 hours; the ratio of the weight of neutral water to the weight of NC is about 2:1 to 15:1; the first and second alkaline boiling periods have durations of 1 to 10 hours or about 4 hours; the ratio of the weight of water to the weight of NC is between 2:1 and 15:1 in the alkaline boiling regimen.

In further non-limiting examples, the boiling stabilization process step 12 can comprise an acid boiling regimen, which includes an acid boiling period conducted at an elevated temperature and under pressure; a neutral boil regimen; an optional organic solvent solution boiling regimen; and an alkaline boil regimen. In a variation of the example, the organic solvent solution boiling regimen is excluded.

In these and other various embodiments, the boiling stabilization process step can comprises one acid boil period; one neutral boil period; one alkaline boil period; and no organic solvent solution boil periods. In some embodiments, the process step is limited to no more than one neutral boil period; no more than one alkaline boil period; or no more than one neutral boil period and no more than one alkaline boil period.

Conditions and formulations for the above example variations can include, all, any or combinations of the conditions and formulations noted above and the following:

The acid boiling period duration can be: no more than 140 hours, 50 hours or less, 30 hours or less, 15 hours or less, 10 hours or less, about 24 hours, about 12 hours or can be about 8 hours. The boiling temperature can be: at least 110° C., at least 115° C., at least about 130° C., 110° C. to 140° C., 115° C. to 135° C., about 115° C., or about 130° C. The ratio of the weight of water to the weight of NC in the acid boil can be about 2:1 to 15:1, about 13:1, about 7:1 or about 3-4:1.

The organic solvent solution is excluded or is included and is an ethanol solution, which can comprise at least 25% EtOH.

A neutral boiling regimen is included and the number of periods is one or one or more. The period(s) duration is about 1 to 10 hours, about 3 to 7 hours, about 9-10 hours or about 5 hours. The ratio of the weight of neutral water solution to the weight of NC is about 2:1 to 15:1, about 13:1, about 7:1 or about 3-4:1.

An alkaline boiling regimen is included and the number of periods is one or one or more. The period(s) duration is about 1 to 10 hours, about 3 to 7 hours, about 9-10 hours or about 5 hours. The ratio of the weight of alkaline water solution to the weight of NC is about 2:1 to 15:1, about 13:1, about 7:1 or about 3-4:1. In some embodiments, the water solution further comprises a weak base substance, which is included at about 0.005 g to about 0.01 g of weak base per gram of NC or in the amount of about 0.4 g/l. In some embodiments, the weak base substance is soda ash.

In some embodiments, the boiling stabilization process step comprises or consists essentially of one acid boil period at an elevated temperature and elevated pressure, one neutral boil period and one alkaline boil period. In some embodiments, the boiling temperature of the acid boil is about 115° C. and the combination of durations (in hours) of the acid boil period, the neutral boil period and the alkaline boil period, respectively, is about 24, 9 and 9. In some embodiments, the boiling temperature of the acid boil is about 130° C. and the combination of durations (in hours) of the acid boil period, the neutral boil period and the alkaline boil period, respectively, is chosen from the group consisting of about: 8, 10 and 5; 8, 5 and 10; 12, 10 and 5; 12, 5 and 10 and 12, 10 and 10.

Chemical Impregnation:

In some embodiments, the NC propellant production process can further include a chemical impregnation step 14 to incorporate chemicals to the NC particles as desired for the final propellant product. This can include impregnation of the NC particles with a chemical solution comprising chemical stabilizer(s).

Figure 4:
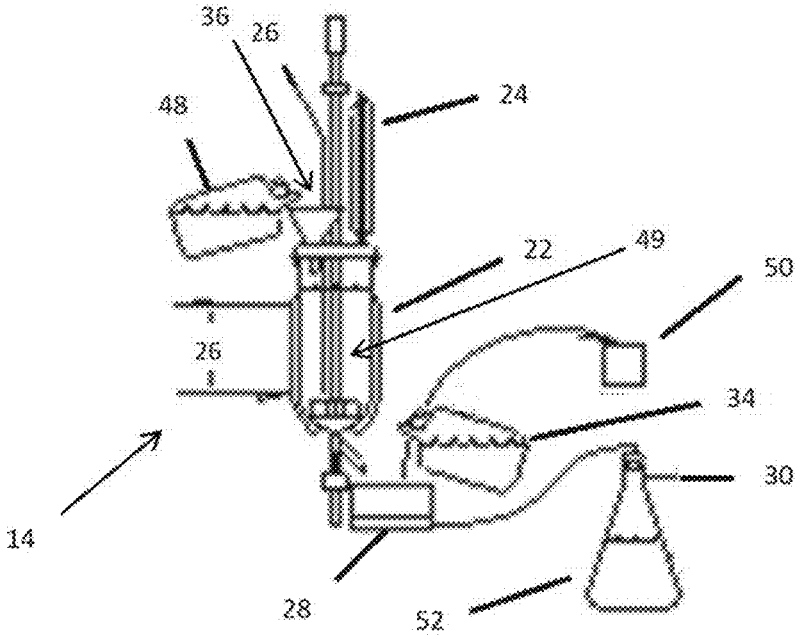
FIG. 4 is a flow diagram of a chemical impregnation process in accordance with an embodiment of the invention.

FIG. 4 shows a schematic of an example of the chemical impregnation process step 14. In the process illustrated in FIG. 4, the stabilized NC particles are impregnated with a stabilizer solution 48. The NC particles 36, after being subjected to the boiling stabilization process step 12, can be mixed with the chemical stabilizer solution 48. The chemical stabilizer solution 48 can be introduced into a reactor 22 incorporating a condenser 24. The NC particles 36 are added to produce an NC particle and chemical stabilizer solution mixture 49. The mixture 49 is heated and allowed to reflux for a period of time. The stabilizer treated mixture 49 can then be filtered 28 under vacuum 30 so as to isolate diffused NC particles 50 and collect spent and excess chemical stabilizer solution 52. The NC particles 50 can then be rinsed with water at ambient temperature.

In some embodiments, the temperature 26 can be maintained in some embodiments at a temperature of about 20° C. to 78° C., in some embodiments at an elevated temperature of 37° C. or above and in some embodiments at a temperature of 70° C. or above. The mixture can be allowed to reflux for 0.5 to 10 hours, in some embodiments 1-5 hours and in some embodiments about 2 hours. The volume of rinsing water can be between a 1:1 and 10:1 ratio of the weight of water to the weight of NC particles being rinsed.

In some embodiments, the produced NC particles can comprise less than about 2% chemical stabilizer and in some embodiments about 0.5 to 2%. In some embodiments, the stabilizer material can additionally be used as a deterrent coating. In some embodiments in such cases, the stabilizer material can make up to 12% of final weight of the NC propellant product. In some embodiments of the NC propellant production process, the NC particles are not subjected to stabilizer impregnation.

As an example, the stabilizer solution can be an Akardite solution. The Akardite solution can comprise 0.5 w/w % to 20 w/w % Akardite in ethanol and in some embodiments 2.0 to 4.0 w/w % Akardite in ethanol. As an example, the NC particles 36 can be mixed in the solution at a ratio of 0.1 kg/l to 1 kg/l, and in some embodiments, about 0.25 kg/l.

Figure 5:
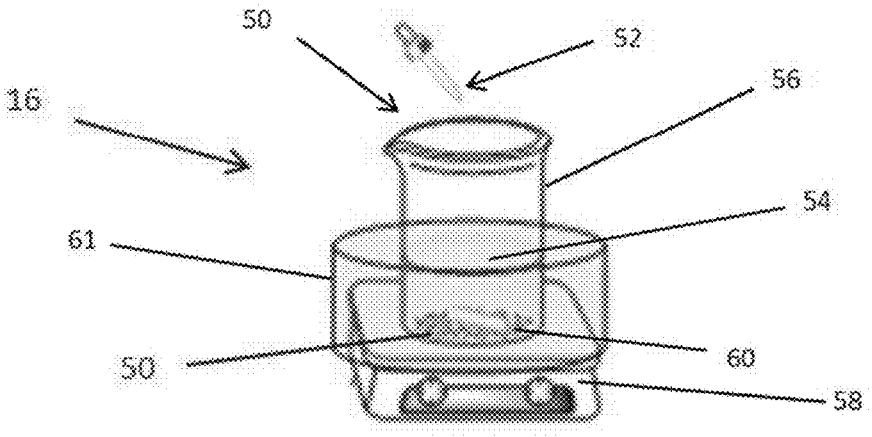
FIG. 5 is a side perspective view of a representation of a nitroglycerin impregnation process in accordance with an embodiment of the invention.

NG Impregnation:

In some embodiments, the NC propellant production process can further include an NG impregnation step 16, which can be incorporated if the desired end product is to be a double based propellant. FIG. 5 shows an illustration of an example of the NG impregnation process step 16. The NC particles, after being subjected to the chemical impregnation process step 14 and/or the boiling stabilization step 12, can be impregnated with NG 52. By way of example, FIG. 5 shows an amount of the NC particles 50 in water 54 in a suitable container 56, such as a beaker. The container 56 can be positioned in a dish 61, or other suitable container, which can service as a water bath. The container 56 and dish 61 are positioned on a stir plate 58 to provide heat and mixing. An amount of water is used, for example, about 10 ml/g of NC particles 50.

The contents in the container 54 can then be heated and stirred. In an embodiment of the disclosure, an example of the temperature of the water can be about 40° C. An amount of NG solution 52 can be gently added to the water 54. After adding an amount of the NG solution 52, the mixture can be allowed to impregnate or diffuse for a suitable period, for example about 1.5 hours. In an embodiment of the disclosure, a portion, for example about half, of the NG solution 52 can be added at the 0 minute mark of the impregnation or diffusion period and a portion, for example about half, of the NG solution 52 can be added at a later time, for example at the 30 minute mark of the impregnation or diffusion period.

After the impregnation or diffusion period, the NG impregnated NC particles 50 can be rinsed. In an embodiment, the NG impregnated NC particles 50 can be washed with a suitable amount of fresh water. Stirring can be maintained during the washing. The resulting NG content can be tailored according to desired characteristics by adjusting the conditions accordingly.

Conditions can be adjusted according to desired results. In an embodiment, an example of a suitable amount of NG solution 52 used for impregnation can be 0.1 gram NG/gram NC particles to 1 gram NG/gram NC particles and in an embodiment about 0.4 ml of a 50% NG solution per gram of NC particles 50. In an embodiment, an example of the NG solution 52 can be 50% NG/50% acetone. In a further example, the NG can be in the form of 'neat' NG or can be diluted in a suitable solvent to form an NG solution. An example of rinsing can be rinsing the NG impregnated NC particles 50 with fresh water in the amount of about 10 ml/g of NC particles 50 multiple times, for example three. Examples of NG content for the resulting NG impregnated NC (NG/NC) particles 60 include about 11% NG for nitrated MCC starting material and about 15% NG for nitrated spherical regenerated cellulose starting material.

In some embodiments, rather than adding the nitrate ester to the nitrated and stabilized NC at this stage, the propellant can be formulated to be a double-base propellant by mixing or combining the non-nitrated starting material with a second energetic material, including one or mixtures of energetic plasticizers, nitrate esters, as described below, and/or energetic solids, such as RDX, HMX or other energetic solids not sensitive to nitric or sulfuric acid. This can be done by conventional mixing means, including, but not limited to combining in a slurry. The combination is then shaped and moved to the nitration process. In some embodiment, the mixture/combination can be extruded in the shaping process. In some embodiments, the starting material can be mixed/combined with the second energetic material from 0 to 40%, Drying:

The NC or NG/NC particles can then be subjected to a drying step 19, where the NC or NC/NG particles are dried via typical methods in the field of art, for example hot air drying, vacuum drying and dielectric heating.

Batching/Finishing:

In some embodiments, the NC propellant production process can then include a batching/finishing step 23, as necessary for the desired final propellant product. Batching involves mixing the particles with other lots of the same or similar types of particles to provide uniformity in the final propellant product. Before, after or during the batching, the particles can be subject to a finishing step(s), which involves the application or the blending in of various propellant components, including coatings and additives, as desired in accordance with the desired end product. Mixing and coating can be performed by convention methods well known in the industry, including, as an example, via tumblers, also known as sweetie barrels.

Finishing:

According to the desired features of the final propellant product, various further propellant components, including additives or coatings, independently or in combinations, can be added, contemporaneously or consecutively, to and mixed with the NC or NC/NG particles. Propellant components can be added by mixing in or by glazing. Non-limiting examples of finishing additives or coatings include the following.

A deterrent coating can be incorporated, if desired in the end product. Deterrent coatings can be applied, for example, to aid progressivity, tune energy release for gun applications, reduce the initial burning rate on the surface, as well as to reduce initial flame temperature and ignitability. The coating can also broaden the pressure peak and increases efficiency. Such a coating can be applied to the diffused NC or NG/NC particles 50,60 separately or in a finishing mixture, and can be done on a large scale, for example in a tumbler, or a small scale, for example as shown in FIG. 6.

Figure 6:
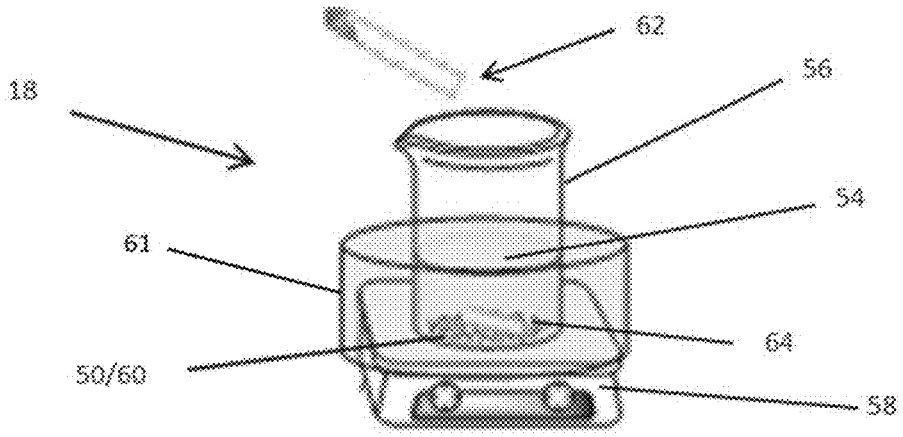
FIG. 6 is a side perspective view of a representation of a deterrent coating process in accordance with an embodiment of the invention.

As an example, FIG. 6 shows a small scale example of the application of a deterrent coating 18 onto NC or NC/NG particles 50/60, according to some embodiments. An amount of the NC particles 50 or NG/NC particles 60 can be added to water 54 in a suitable container 56, such as a beaker. The container 56 can be positioned in a dish 61, or other suitable container, which can service as a water bath. The container 56 and dish 61 can be positioned on a stir plate 58 to provide heat and mixing. The water 54 can be heated and stirred. An amount of deterrent solution 62 can then be added to the water 54. After adding an amount of the deterrent 62, the mixture is allowed to interact for a suitable coating period. After the coating period, if the coated NG/NC or NC 64 is sticky or tacky beyond a desired level, it can be rinsed with fresh water. In an embodiment, the coated NG/NC or NC 64 can be washed with a suitable amount of fresh water. Stirring can be maintained during the washing.

Conditions can be adjusted according to desired results. In some embodiments, the following, individually and in combinations, are non-limiting examples of conditions; the amount of water used for the water can be about 5-7 ml/g of particles; the temperature of the water bath can be about 88° C.; the amount of deterrent solution 62 used for coating can be about 0.117 g of deterrent, such as Herkote for example, per gram of particles; and a suitable coating period can be about 1.5 hours. Further examples of deterrent and other coatings are shown below. Examples of coating levels for the resulting coated NG/NC or NC 64 include about 5-9% coating, 5-6% coating, and 7-9% coating. As mentioned above, the conditions can be scaled up to accommodate larger lots and batches and could be performed in larger vessels, for example barrels.

At least one flash suppressor can be added. As an example, flash suppressants can be used to interrupt free-radical chain reaction in muzzle gases and work against secondary flash. They are typically alkali or alkaline earth salts that either are contained in the formulation of the propellant or exist as separate granules to be mixed in. Non-limiting examples include potassium sulfate, potassium chloride, potassium nitrate, and potassium hydrogen tartrate. As a non-limiting example, the at least one flash suppressor can be included in the amount of about 0.1 wt % to 5.0 wt % of the total weight of the propellant composition.

At least one opacifier can be included. Opacifiers can be used, for example, to enhance reproducibility and keep radiant heat from penetrating the surface and can be used to enhance burn rate. Examples include graphite, carbon fibers and/or carbon black. The opacifier(s) can be added in a conventional manner, for example by coating. A graphite glaze can be used, for example to coat the particles to improve flow and packing density as well as to reduce static sensitivity and increase conductivity. As a non-limiting example, the carbon black can be a high surface area carbon black having a surface area of greater than or equal to about 25 $m^2/g$. For example, the least one carbon compound can be present in an amount of 0.1 wt % to 1.0 wt % of the total weight of the propellant composition.

The propellant composition can further include at least one surfactant, an example of which can be a rosin. As an example, the at least one surfactant can be present in an amount of about 0 wt % to 12 wt % of the total weight of the propellant composition.

At least one oxidizer can further be added. Oxidizer(s) can be present as a powder or in a particulate form. As a non-limiting example, oxidizer(s) can be present in an amount of about 0 wt % to 10 wt % of the total weight of the propellant composition. Non-limiting examples of oxidizers are shown below.

To further tailor the ballistic properties of the propellant, such as the burn rate and the velocity, materials that control ballistic properties, so-called "ballistic modifiers," can further be added. Various organometallic salts and various oxides can be added to modify the ballistic properties of propellants, such as double base propellants. Non-limiting examples of such ballistic modifiers include lead-based compounds, such as, lead salts and lead oxides (e.g., lead salicylate, lead β-resorcylate and lead stearate).

De-coppering agents can be added, for example to aid in removing copper residues from the rifling of gun barrels. Non-limiting examples of de-coppering additives include tin metal and compounds thereof, for example tin dioxide, bismuth metal and compounds thereof, for example bismuth trioxide, bismuth subcarbonate, bismuth nitrate, bismuth antimonide and lead foil and lead compounds.

Blending/Propellant Packaging:

The NC propellant production process can then further include a blending and propellant packaging step 25, as necessary for the desired final propellant product. Blending involves blending batched particles with particles of differing types in accordance with the desired final propellant product. The blended propellant is then packaged for storage or delivery of the produced propellant product. Packaging can occur without blending if no additional materials are desired in the final product.

Process Reduction/Consolidation:

The propellant production processes disclosed herein have advantages over traditional propellant production processes. In some embodiments, propellant production processes of the disclosure reduce, alter and/or consolidate the steps involved in traditional NC based propellant production processes; and, at the same time, produce propellants which exhibit complete stabilization and ultimate nitrogen substitution ranges that are useful to the small arms industry.

In some embodiments, non-limiting examples of steps that can be excluded from the traditional NC based propellant production process, which comprises the NC production process and the propellant production process, include, but are not limited to, the NC production process steps of: refining the NC; poaching the NC smaller pieces; screening the poached smaller pieces; blending the screened NC with other batches of poached and screened NC; dewatering the blended NC; dehydrating the centrifuged NC; blocking; block breaking; and premixing NG and NC, and the NC production process steps of: blocking; extruding and cutting; and screening. In some embodiments, the processes of the present disclosure can exclude any, all or combinations of the above steps.

Advantages of the present processes do not only include the reduction of specific steps, but the altering and reordering of certain steps and the inclusion of different steps. Methods disclosed herein do not require traditional refining processes, but it does include a unique boiling stabilization step. In the present disclosure, the boiling stabilization of the nitrated material effects release of entrained acid species. As such, traditional refining steps, such as chopping the pre-shaped nitrated material, can be excluded from the preparation process. The boiling stabilization process and the chemical impregnation process of the present disclosure provide a purification/stabilization process which effects a refining of the NC particles, promoting the release of entrained acid species and the infusion of stabilization agents.

The purification/stabilization process obviates traditional refining techniques, thus preserving the integrity of the pre-shaped nitrated material while providing propellant that meets stability and performance requirements. The organic solvent solution boiling step effectuates a swelling of the NC material, accommodating diffusion or migration of the chemical stabilizer into the NC material and diffusion or migration of any entrained acid species out of the NC material, refining the material and providing conditions to meet stability requirements.

The organic solvent solution treatment, for example the ethanol boil, effectuates a purification/stabilization process, purifying the material from entrained acid species and improving the efficiency and effectiveness of the stabilizer impregnation step. The treatment reduces the amount of stabilizer needed and removes the necessity of traditional refining steps (chopping-up) applied to the pre-shaped nitrated material. Further, the boiling stabilization of the present disclosure resulting propellant material can be prepared to meet NC stability and shelf life requirements without an excess amount of chemical stabilizer. In some embodiments, as an example, the stabilizer can be present in an amount of about 0.5 wt % to 5.0 wt % of the total weight of the propellant composition. In some embodiments, the stabilizer can comprise 0.5 wt % or less of the total weight of the propellant composition.

The processes of the present disclosure, according to some embodiments, are further advantageous over traditional methods at least because the arrangement and construction of the process steps produce a homogeneous dispersion of NG, when added, with the NC particles. In the traditional propellant production process, as discussed above, the NC material is premixed with NG at the end of the NC Production process. In the NG/NC premix step, NG is poured on top of the broken up pieces of NC material, which would have been formed in the step immediately prior to the NG premix step in the block breaking step. After receipt of the NC/NG premix for use in the Propellant Production Process, various other ingredients are mixed into the premix and then the combined mix is blocked and thereafter extruded. In contrast, in some embodiments, the present disclosure provides for an impregnation of the pre-shaped NC with NG via a mixing in solution, effectuating a homogeneous dispersion of the NG with the NC particles.

Further, during the traditional Propellant Production Process, the NG/NC premix is heated extruded under pressure to form the propellant particles. Under such heating and extrusion under pressure, NG is susceptible to melting out, worsening the homogeneity. In contrast, the present disclosure provides that the NG is added to and mixed with the NC material after the NC particles have been shaped. The NC/NG is not subjected to such extrusion pressure and conditions.

The processes of the present disclosure, according to some embodiments, are further advantageous over traditional methods at least because produced propellant product is cleaner and exhibit improved flow characteristics. Improved flow can facilitate easier incorporation into a final end product, for example, rocket motors.

The processes of the present disclosure, according to some embodiments, are still further advantageous over traditional methods at least because the integrity and shape of propellant particles can be predetermined and maintained. The processes of the traditional method include multiple post nitration steps that prevent predetermining and maintaining the integrity and shape of the propellant, including the steps of refining, blocking, block breaking, extruding and cutting. The substantive physical manipulation of these steps prohibits such control. In contrast, the methods of the present disclosure allows for predetermining and maintaining the integrity and shape of the propellant, as the propellant particles are not subject to substantive physical manipulation, rather agitation, swirling and possible tumbling.

The methods of the present disclosure include further advantages over traditional methods. The reduction of steps and the consolidation in steps reduces costs and labor, provides flexibility in starting material, which can result in lower material costs, and provides flexibility in the availability of a wider range of available shapes and sizes that can be produced. The reduced process time further allows for more frequent product runs. The embodiments of the present disclosure further allow for the production of propellant in a continuous process that can be performed at a single location, in contrast to traditional propellant production, which must adhere to the quantity distance arc requirement.

Further advantages include the ability to use low cost spherical powder instead of Ball Powder. Less capital equipment is required because of the limited and shorter method steps required for production. The methods of the present disclosure further make commercially available, optionally pre-shaped starting materials, for example microcrystalline cellulose (MCC), available for simpler production into gun propellant. The present methods further make use of smaller and more complex shapes available for use as gun propellants. The methods allow use of lower cost, high volume modern plastics processing equipment and facilities, as opposed to batch propellant processing equipment and facilities. The methods of the present disclosure further provide a clear delineation of process steps that culminates in actual propellant performance data (i.e. ballistics).

Propellant Characteristics:

In some embodiments of the disclosure, the propellant comprises completely stabilized NC or NC/NG based particles having predetermined shapes and sizes. After stabilization, the pre-shaped NC particles can be processed as desired. The propellant production process produces propellant which reliably exhibits complete stabilization and has a high shelf life, and can further exhibit complete nitration, ultimate nitrogen substitution ranges and acceptable ballistic performance characteristics, such that the resulting propellants are useful to the small arms industry.

Since the nitrated pre-shaped starting material maintains its shape and size through the process, the final product propellant can comprise particles having predetermined shapes and sizes. Non-limiting examples of the pre-shaped cellulose particles, and therefore the propellant particles, include spheres, cylinders, granules, flake powder, pellets and disk-like configurations. Starting material and the sizes and shapes of particles are further discussed below. In some embodiments, the resulting NC particles can maintain their structural integrity and resist and do not exhibit collapse, cracking, splitting and/or rupturing. For example, NC spheres do not collapse and lose their spherical characteristics.

In some embodiments, NC particles, after the nitration step and the boiling stabilization process step, further comprise at least 12% nitrogen, and in some embodiments at least 12.5%, and in some embodiments at least 13% nitrogen, and in some embodiments 13.5% nitrogen. In some embodiments, the NC is further completely stabilized, having a German test time (actual) of at least 30 minutes. In some embodiments, the German test time of NC is at least 32 minutes. The German Test is defined in MIL-SPEC-286C method 404.1.2. For the processes of the current disclosure, the German Test is conducted after the boiling stabilization step 12 and before the chemical impregnation step 14. In some embodiments, the German Test is conducted after the chemical impregnation step 14 and before the NG impregnation step 16. For comparison purposes, in a traditional NC based propellant production process, the German Test is conducted in the NC production process, after the poaching step and before the screening step.

In some embodiments, the NC particles can further exhibit complete nitration. Completeness of nitration, which is distinct from nitrogen concentration, is the measure of nitration through an NC particle. Complete nitration is nitration penetration through the entire material of the NC particle. Completeness of nitration can be validated with an acetone insoluble test, with nearly complete solubility indicating complete nitration. Cellulose is insoluble in acetone and NC with less than 10% nitrogen is insoluble in acetone. NC with more than 10% nitrogen is completely soluble, meaning about 98% to 100% soluble, in acetone. So the simple acetone insoluble test can easily show completeness of nitration.

In some embodiments of the disclosure, examples of sizes of NC particles that exhibit complete stabilization include: up to and including 1 mm in diameter or length; diameters or lengths of 28 microns or more; diameters or lengths of 50 microns or more; diameters or lengths of 100 microns or more; diameters or lengths of 200 microns or more; diameters or lengths of 28 microns to 1 mm; diameters or lengths of 50 microns to 1 mm; diameters or lengths of 100 microns to 1 mm; diameters or lengths of 200 microns to 1 mm; diameters or lengths of 300 microns to 1 mm; and about 500 microns to 1 mm in diameter or length.

In some embodiments, the NC particles of the above ranges can further exhibit complete nitration. In some embodiments, the NC particles of the above ranges can further exhibit high nitration concentrations, including in the ranges of at least 12% nitrogen; at least 12.5%; at least 13% nitrogen; or at least 13.5% nitrogen. In some embodiments, the NC particles of the above size ranges can further exhibit complete nitration and high nitration concentrations in the above ranges. A further example includes nitrated cellulose (MCC) particles of about 500 microns in diameter exhibiting complete nitration and stabilization. Starting material and the sizes and shapes of particles are further discussed below.

In comparison to propellant made via traditional propellant production processes, propellants produced by some embodiments of the present disclosure further differ in that: they can have a lower bulk density; their cross-sections appear and are felted (fibrous) and less plasticized, whereas the cross sectional area of propellant made by traditional propellant manufacturing processes will not be or appear felted and will appear to be plasticized; some additives, such as flash suppressant, burn modifiers and de-coppering agents, may not be incorporated throughout the cellulose matrix of the propellant, whereas, in propellant made by traditional propellant manufacturing processes, such can be incorporated throughout the cellulose matrix due to the mixing of the propellant components prior to extrusion; the propellant NC material is significantly less viscous than NC material used in the traditional propellant manufacturing process, as determined by a standard viscosity test; they are not limited to the sizes and shapes of propellants made by traditional propellant manufacturing processes, in that they are typically limited to particular extruded shapes; and the NC material for propellants made by some embodiments of the present disclosure can have a lower molecular weight.

Cellulose Starting Materials and Particle Shapes and Sizes:

Starting material for the propellant production process can comprises a material which can be converted to an energetic binder, which can be used as a primary energetic material in a propellant, using the processing steps disclosed herein. Starting materials can include, for example, cellulosic and/or polysaccharide material, for example cellulose, microcrystalline cellulose (MCC), cellulose esters, or cellulose ethers, which can be in various forms, for example cellophane or microcrystalline cellulose, polyvinyl alcohol, or polyvinyl acetate, and mixtures and combinations thereof. Such starting materials are available from various sources.

Further specific examples of starting material or cellulose particles include, but are not limited to, MCC Spheres and non-spherical (irregular or granular shapes) and powdered cellulose, including sizes 100, 200, 350, 500, 700 and 1000, regenerated cellulose spheres (20 um-1.1 mm), regenerated cellulose cylinders, 5% CAB infused pulp, Guar Gum infused pulp, ionic liquid infused/removed pulp punched from a sheet (may comprise plasticizer prior to punching), and Guar Gum pellets.

In some embodiments, the starting material can include a single or mixture of plasticizers. Examples of energetic plasticizers include, but are not limited to, nitroglycerine, also known as trinitroglycerine, (NG), trimethylolethane trinitrate (TMETN), triethylene glycol dinitrate (TEGDN), butanetriol trinitrate (BTTN), diethyleneglycol dinitrate (DEGDN), propylene glycol dinitrate (PGDN), ethylene glycol dinitrate (EGDN), butyl-2-nitratoethyl-nitramine (BuNENA), methyl-2-nitratoethyl-nitramine (MeNENA) and ethyl-2-nitratoethyl-nitramine (EtNENA). The starting material can be plasticized with the energetic plasticizer from 0 to 40%, increasing the energy density of the propellant composition. In some embodiments, the propellant is free of such plasticizers.

In some embodiments, double-based propellants may be formulated by mixing or combining the non-nitrated starting material (prior to nitration) with a second energetic material, for example, the single or mixture of energetic plasticizers, nitrate esters, as described above, and/or energetic solids, such as RDX, HMX or other energetic solids not sensitive to nitric or sulfuric acid. This can be done rather than adding the nitrate ester to the nitrated and stabilized NC at impregnation stage (after nitration and stabilization of the starting material) to formulate the double-base propellant. This can be done by conventional mixing means, including, but not limited to combining in a slurry. The combination/mixture is then shaped as desired or other addressed herein and moved to the nitration process. In some embodiment, the mixture/combination can be extruded in the shaping process. In some embodiments, the starting material can be mixed/combined with the second energetic material from 0 to 40%, In some embodiments, the starting material can be guar and the second energetic material can be RDX.

The starting material can have various configurations, including but not limited to spheres, cylinders, granules, flake powder, pellets or disk-like configurations. Examples of the size of the starting material or cellulose particles include, but are not limited to, particles having sizes in the ranges of: up to and including 1 mm in diameter or length; diameters or lengths of 50 microns or more; diameters or lengths of 100 microns or more; diameters or lengths of 200 microns or more; diameters or lengths of 50 microns to 1 mm; diameters or lengths of 100 microns to 1 mm; diameters or lengths of 200 microns to 1 mm; diameters or lengths of 300 microns to 1 mm; diameters or lengths 500 microns to 1 mm; and diameters of 1 nm to 5 mm. Disks can further have a thickness within any of the above ranges.

Some configurations, for example the disk configurations, can have perforations. As an example, the disks can have 1 to 13 perforations; 3 to 9 perforations; or 5 to 7 perforations. Producing perforations through extrusion processing can be found, as a non-limiting example, in US Publication 20050193915 (Worrell, et al., Sep. 8, 2005). As the methods of the present disclosure The methods of the present disclosure allow for the production of high performance products due to the shaping flexibility of the starting material prior to nitration and the maintaining of the starting materials original shape throughout the production process. As an example, the starting material of the present disclosure can be extruded in particles smaller than is possible with traditional propellant processing equipment. For example, 7-perf grains or particles can be produced that are smaller than is possible with current propellant processing equipment. As such, the methods of the present disclosure can be used to produce propellant for small caliber cartridges, for example 5.56 mm and 7.62 mm.

Figure 7:
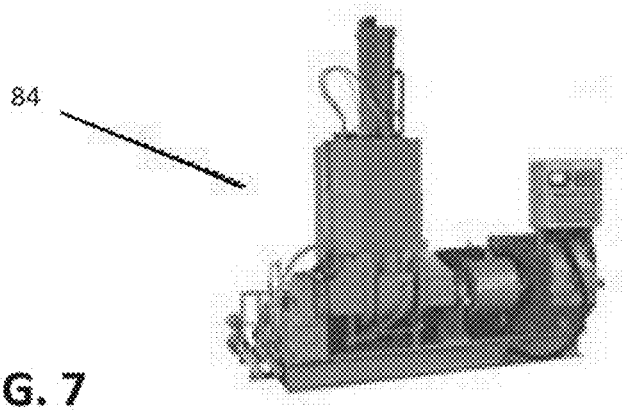
FIG. 7 is a side perspective view of a mixtruder which may be used in the production of cellulose particles in accordance with an embodiment of the invention.

Starting material particles, such as cellulose derivatives particles, can be formed using single or multi screw extruders commonly used for extrusion of non-energetic thermoplastics. As an example, a mixtruder, an example of which is shown in FIG. 7 (sigma mixer attached to a screw extruder 84 (MIKRONS)) can be used. In an embodiment, the cellulose derivatives material can be mixed with solvent and then extruded and then pelletize. The individual particles can further be perfed as desired.

Additional Materials:

Examples of nitrating agents or acids include, but are not limited to, concentrated solutions of nitric acid or sulfuric acid, such as 99% nitric acid or 98% sulfuric acid, mixtures comprising nitric acid/sulfuric acid, sulfuric acid, nitric acid and water ($H_2SO_4/HNO_3/H_2O$), nitric acid/organic solvent (including, but not limited to, methylene chloride), sulfuric acid/inorganic nitrate salt(s) (including, but not limited to, ammonium nitrate, sodium nitrate, potassium nitrate), nitric acid/acetic anhydride, nitric acid/phosphoric acid, nitric acid/phosphorous pentoxide/solvent, nitronium salts, and other nitrating agents known in the art. In some embodiments disclosed herein, the nitrating agent can comprise a mixture comprising nitric acid and sulfuric acid, a nitric acid/acetic anhydride nitrating mixture, or a electrochemical nitrating mixture, for example dinitrogen pentoxide.

Examples of stabilizers include nitrogen oxides absorbing compounds including, but not limited to, Akardite/Akardite II (1-methyl-3,3-diphenylurea), also called Methyl Diphenylurea (also may be used as a burning rate modifier); Diphenylamine (DPA); Akardite II/ethanol mixture, Akardite II (1.1%) and nitroglycerine (9.5%) mixture; 2,4-Dintrotoluene (DNT), also may be used as a ballistic modifier (homogenizer); 1,3-diethyl-1,3-diphenylurea (so-called "ethyl centralite", "carbamite", "Centralite I" or "Symmetrical Diethyl Diphenylurea") (may be used as a gelatinizer and waterproofing agent and may be used as up to 8% of the propellant composition); methyl centralite, also called Centralite II or Symmetrical Dimethyl Diphenylurea; N-Methyl-P-Nitroaniline (MNA); 2-Nitrodiphenylamine (2NDPA, 2-NDPA) (used for double-base and triple-base propellants which use Nitroglycerin); N-nitrosodiphenylamine; carbonates (e.g., calcium carbonate); magnesium oxide; sodium bicarbonate; beta-naphthol methyl ether; and combinations thereof. As an example, in some embodiments, the stabilizer can be present in an amount of 0.5 wt % to 5.0 wt % of the total weight of the propellant composition. In some embodiments, the stabilizer can comprise 0.5 wt % or less of the total weight of the propellant composition.

Examples of deterrents, deterrent coatings and other coatings include, but are not limited to, Herkote (Paraplex G-54 polyester), dibutyl phthalate, dinitrotoluene, centralites (symmetrical diphenyl urea-ethyl, diethyl, methyl or dimethyl), dioctyl phthalate, camphor, Vinsol resin, ortho-tolyl urethane, polyester adipate, and graphite.

Examples of oxidizers include, but are not limited to, nitrate compounds (e.g., potassium nitrate, lithium nitrate, beryllium nitrate, sodium nitrate, magnesium nitrate, calcium nitrate, rubidium nitrate, strontium nitrate and cesium nitrate), ammonium perchlorate (AP), ammonium nitrate (AN), hydroxylammonium nitrate (HAN), ammonium dinitramide (ADN), potassium dinitramide (KDN), potassium perchlorate (KP), and combinations thereof. The at least one oxidizer can be present as a powder or in a particulate form.

ADDITIONAL EXAMPLES

The following are non-limiting examples of aspects of the disclosure including examples of embodiments of the process and the materials at various periods of time along the propellant production process.

Partial Propellant Production Process Examples:

The following is an example with example variations of an amount of cellulose particles subjected to the PSCP Nitration Step 10 through the NG Impregnation Step 16. It further includes an embodiment of the finishing step 23, specifically a deterrent coating step. The example illustrates a small scale process using the equipment and process illustrated in FIGS. 2-6. It should be understood that the scale can be increased and performed with suitable materials and equipment.

PSCP Nitration (see FIG. 2):

1—0.5 kg of MCC or cellulose spheres is added to 9.4 L of a concentrated solution of $HNO_3/H_2SO_4$ mixture in a reactor;

2—the mixture is heated to a temperature in the range of 25–40° C., with agitation, for a period of about 1 hour;

3—the resulting nitrated cellulose acid mixture is then filtered by vacuum to isolate NC particles and remove the spent acid;

4—the filtered NC particles are then quickly quenched with 30 L of cold water; and 5—the NC particles in a small quantity of water are then removed.

Boiling Stabilization (see FIG. 3):

Acid Boil:

1—About 0.8 kg of the NC particles is added to 10 L of water and boiled (boiling temperature or 99° C.) for 70 hours;

Neutral Boil:

1—about 0.8 kg of the NC particles is added to 10 L of water and boiled (boiling temperature or 99° C.) for 5 hours; and 2—the about 0.8 kg of NC particles is then added to another 10 L of water and boiled (boiling temperature or 99° C.) for 5 hours.

Organic Solvent Solution Boil:

1—the about 0.8 kg of NC particles is added to 10 L of a solution comprising 100% EtOH in water and boiled for 5 hours; and 2—the about 0.8 kg of NC particles is then added to another 10 L of a solution comprising 100% EtOH and boiled for 5 hours.

Alkaline Boil:

1—the about 0.8 kg of the NC particles is added to 10 L of water having about 4 g of Soda Ash and boiled (boiling temperature or 99° C.) for 4 hours; and 2—the about 0.8 kg of the NC particles is then added to another 10 L of water having about 4 g of Soda Ash and boiled (boiling temperature or 99° C.) for 4 hours.

In some variations of this example, the Neutral Boil is skipped or reduced to one Neutral Boil instead of two. In some variations of this example, the Organic Solvent Boil includes one Organic Solvent boil or three Organic Solvent Boils instead of two. In some variations, when no Neutral Boils are performed, three Organic Solvent Boils are performed. In some variations, when one Neutral Boil is performed, two Organic Solvent Boils are performed. In the above variations, further variations include skipping the alkaline boils or reducing the step to one Alkaline Boil.

In at least some embodiments, the boiling stabilization process step comprises or consists essentially of one acid boil period at an elevated temperature and elevated pressure, one neutral boil period and one alkaline boil period. In some embodiments, the organic solvent solution regimen is excluded. The acid boil boiling temperature is: in a first embodiment, at least or about 115° C. and the duration is 20-30 hours or about 24 hours; or, in a second embodiment, at least 125° C. or about 130° C. and the duration is 7-15 hours or about 8 or 12 hours. The neutral boiling regimen is included and the number of periods is one or one or more. The period(s) duration is: in the first embodiment, about 8 to 10 hours or about 9; or, in the second embodiment, about 4 to 11 hours, about 9-11 hours, about 4-6, about 10 or about 5 hours. The alkaline boiling regimen is included and the number of periods is one or one or more. The period(s) duration is: in the first embodiment, about 8 to 10 hours or about 9; or, in the second embodiment, about 4 to 11 hours, about 9-11 hours, about 4-6, about 10 or about 5 hours. The water solution of the alkaline boil further comprises a weak base substance, which is included at about 0.005 g to about 0.01 g of weak base per gram of NC or in the amount of about 0.4 g/l. In some embodiments, the weak base substance is soda ash. In the first embodiment, the total duration of the neutral and alkaline boils can be about 16 to 20 hours or about 18 hours. In the second embodiment, the total duration of the neutral and alkaline boils can be about 13 to 17 hours or about 15 hours.

Chemical Impregnation (see FIG. 4):

1-0.8 kg of the NC particles is added to 3.2 L of an Akardite solution comprising 4.05 w/w % Akardite in ethanol in a reactor;

2—the mixture is heated to a temperature of about 78° C. and allowed to reflux for about 2 hours;

3—the resulting stabilizer impregnated NC mixture is then filtered by vacuum to isolate NC particles and remove the spent Akardite solution;

4—the filtered stabilizer impregnated NC particles are then rinsed with water; and 5—the stabilizer impregnated NC particles are then removed.

NG Impregnation (see FIG. 5):

The NG Impregnation step is only used for a double-base propellant final product.

1-0.03 kg of the NC the particles is added to water comprising 0.3 L of water at about 40° C.;

2—the water is stirred and 0.012 L of NG solution (50% NG/50% acetone) is added and the mixture is allowed to impregnate or diffuse for about 1.5 hours;

3—the resulting NC/NG particles are then rinsed with 0.3 L of fresh water. The NC/NG particles are similarly rinsed two more times; and 4—the water is then removed from the NC/NG particles and the NC/NG particles can be dried.

(Produces about 11% to 15% NG)

In a variation of the example, a portion, for example about half, of the NG solution can be added at the 0 minute mark of the impregnate or diffuse period and a portion, for example about half, of the NG solution 52 can be added at a later time, for example at the 30 minute mark of the impregnation period.

As mentioned above, in some embodiments, double based propellant is made by mixing or combining the non-nitrated starting material with a second energetic material, including one or mixtures of energetic plasticizers, nitrate esters, as described herein, and/or energetic solids, such as RDX, HMX or other energetic solids not sensitive to nitric or sulfuric acid.

Deterrents Coating Finishing (see FIG. 6):

1-0.03 kg of the NC or NC/NG particles, depending on whether the NG Impregnation step is performed, is added to water comprising 0.2 L of water at about 190° C.;

2—the water is stirred and 3.5 g of Harkote (for 5-6% coating) is added for a coating period of about 1.5 hours;

3—the resulting deterrent coating NC or NC/NG particles are then rinsed with fresh water to remove surface if sticky or tacky. The particles can be rinsed multiple times; and 4—the NC or NC/NG particles can then be dried.

Finishing can include the addition of other additives/coatings according to the disclosure. The resulting propellant can then be batched and/or blended and packaged.

It should be understood that the above example can be altered consistent with the embodiments of the disclosure to reflect other variations in accordance with the desired final product.

Table 1 illustrates further examples of parameters and conditions of the boiling stabilization process step in accordance with the invention and includes test samples and accompanying testing conditions:

TABLE 1

| Sample | NC Source | Acid Boil Regimen (period# × hrs/per)) | Neutral Boil Regimen (period# × hrs/per) | Organic Solvent Boil Regimen (100% EtOH) (period# × hrs/per) | Alkaline Boil Regimen (period# × hrs/per) |
|---|---|---|---|---|---|
| A | Fresh Lab Scale NC | 1 × 70 | 1 × 5 | 2 × 5 | 2 × 4 |
| B | Fresh Lab Scale NC | 1 × 70 | None | 3 × 5 | 2 × 4 |

The above table 1 shows process conditions for the boiling stabilization process step used in the processing and testing of two samples (A and B) using microcrystalline cellulose 350 micron (MCC) starting material. The starting material was nitrated prior to testing.

For samples A and B, tested under the above conditions, the resulting NC was found to comprise 13.52% nitrogen and 13.50% nitrogen, respectively; to have a real German test score of greater than 30 minutes; and to have resisted collapse. The resulting samples met the 134.5° C. stability requirement for NC, as determined by the German test, routinely.

Table 2 illustrates further examples of parameters and conditions of the boiling stabilization process step in accordance with the invention and includes test samples and accompanying testing conditions:

TABLE 2

| Sample | NC Weight (g) | Acid Boil Regimen* (duration) (Temp) (pressure range (psig)) | Neutral Boil Regimen* (duration) | Organic Solvent Boil Regimen (duration) | Alkaline Boil Regimen* (duration) | Total Time (hours) |
|---|---|---|---|---|---|---|
| C | 25 | 24 hours 115° C. 24-33 | 9 hours | None | 9 hours | 42 |
| D | 25 | 24 hours 115° C. 25-36 | 9 hours | None | 9 hours | 42 |
| E | 25 | 12 hours 130° C. 30-88 | 5 hours | None | 5 hours | 22 |
| F | 25 | 8 hours 130° C. 35-68 | 10 hours | None | 5 hours | 23 |
| G | 25 | 8 hours 130° C. 36-69 | 5 hours | None | 10 hours | 23 |
| H | 25 | 12 hours 130° C. 33-90 | 10 hours | None | 5 hours | 27 |
| I | 25 | 12 hours 130° C. 32-89 | 5 hours | None | 10 hours | 27 |
| J | 25 | 12 hours 130° C. 32-88 | 10 hours | None | 10 hours | 32 |

*One boiling period conducted

The above table 2 shows process conditions for the boiling stabilization process step used in the processing and testing of six samples (C-J) of NC particles. For each sample (C-J), 25 g of nitrated pre-shaped cellulose particles was used as the starting material for the boiling stabilization process step. The particles included a mixture of spheres and granules ranging in size from about 200 to 350 microns.

For each of the samples, the 25 g of the NC particles were added to 90 ml of a solution of water in a pressurizable vessel. Each sample was subjected to an acid boil regimen, which included 1 period. The acid boil was conducted by bringing the water solution for each sample up to a boiling temperature noted in Table 2 and substantially maintaining the boiling temperature for the noted duration (hours). The boiling temperature for samples C-D was 115° C. and the boiling temperature for samples E-J was 130° C. After the acid boil period, each sample vessel was drained.

Figure 17:
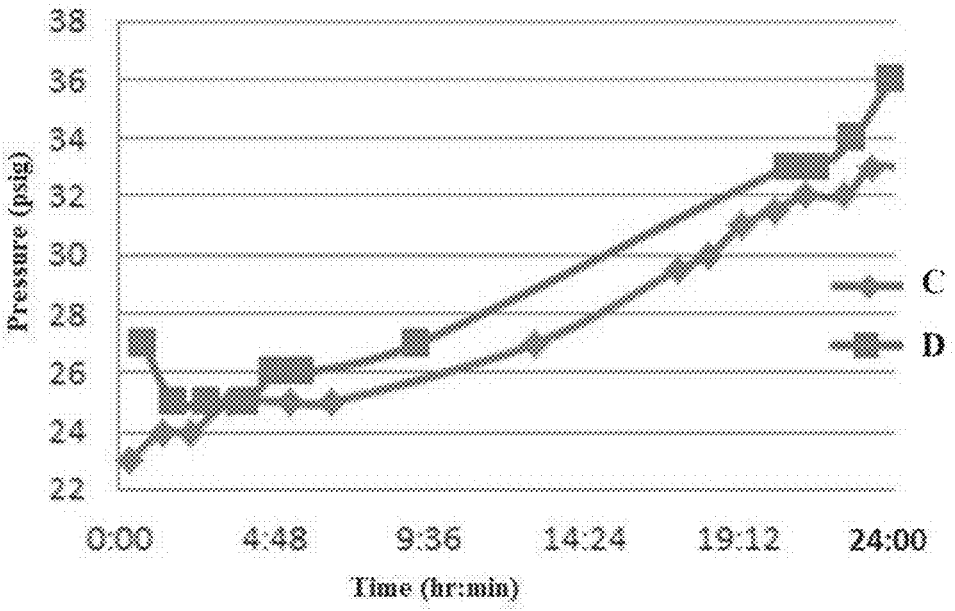
FIG. 17 is a graph showing pressure levels during an acid boiling according to an embodiment of the invention.
Figure 18:
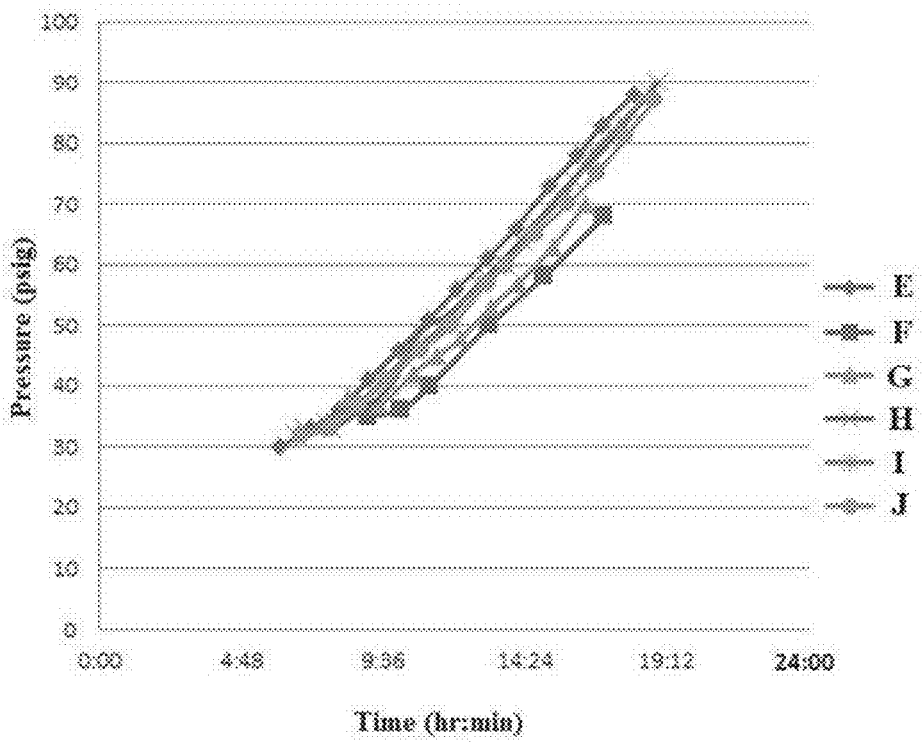
FIG. 18 is a graph showing pressure levels during an acid boiling according to an embodiment of the invention.

The inner pressure of the vessel for each sample over the duration is also shown in Table 2. FIGS. 17-18 illustrate the pressure ranges of the samples. FIG. 17 shows the pressure ranges for samples C and D over their boiling durations. As noted above, the acid boiling temperature for samples C and D was 115° C. and the duration was 24 hours. The weight ratio of water to NC for each sample was about 3.6:1. The average pressure range for samples C-D started at about 24-25 psig and increased to about 33-36 psig.

FIG. 18 shows the pressure ranges for samples E-J over their boiling durations. As noted above, the acid boiling temperature for samples C and D was 130° C. and the duration was 8 or 12 hours, as specified in Table 2. The weight ratio of water to NC for each sample was about 3.6:1. The average pressure range for samples F and G (durations of 8 hours) started at about 35-36 psig and increased to about 68-69 psig; and the average pressure range for samples E and H-J (durations of 12 hours) started at about 30-33 psig and increased to about 88-90 psig.

After the acid boil, 90 ml of a solution of water was added to each sample vessel and each sample was then subjected to a neutral boil regimen. The neutral boil regimen included 1 period at the durations noted above. After the neutral boil period, each sample vessel was drained.

As noted above in Table 2, the boiling stabilization process step for each sample did not include an organic solvent boil regimen. After the neutral boil, 90 ml of a solution of water comprising 0.125-0.25 g of soda ash was added to each sample vessel and each sample was then subjected to an alkaline boil regimen. The alkaline boil regimen included 1 period at the durations noted above. After the alkaline boil period, each sample vessel was drained.

For samples C-J, tested under the conditions noted above in Table 2, the resulting NC was found to comprise at least 13% nitrogen; to have a real German test score of greater than 30 minutes; and to have resisted collapse. The resulting samples met the 134.5° C. stability requirement for NC, as determined by the German test, routinely.

In further exemplary embodiments, there is disclosed herein a method for preparing a propellant for use in small arms cartridges, wherein the propellant comprises nitrocellulose particles having a final shape and size. The method comprises nitrating preshaped cellulose particles having a size of at least 50 microns and a shape of the final shape to form nitrocellulose particles. Thereafter, at the same location, the nitrocellulose particles are stabilized by a series of boiling regimens. The nitrocellulose particles are completely stabilized and exhibit complete nitration and wherein the shape is maintained. The preshaped cellulose particles are not subjected to any added plasticization.

In this and other various embodiments, the method can further comprise providing an amount of the preshaped cellulose particles. Thereafter, the cellulose particles are nitrated sufficiently to produce the nitrocellulose particles having at least 12% nitrogen. The cellulose particles are then stabilized by a series of boiling regimens. The stabilizing comprises the steps of: subjecting the nitrocellulose particles to an acid boil regimen comprising boiling the nitrocellulose particles in an acid boil solution at an elevated temperature of at least 110° C. for a period of no more than 30 hours, the acid boil solution comprising substantially water; thereafter subjecting the nitrocellulose particles to a neutral boiling regimen of the nitrocellulose particles in a first neutral solution for a period of time, the first neutral solution comprising substantially water; and thereafter subjecting the nitrocellulose particles to an alkaline boiling regimen of the nitrocellulose particles in a first alkaline solution for a period of time, the first alkaline solution comprising substantially water, wherein the combined periods of time of the first neutral boiling and the first alkaline boiling is less than 30 hours; and thereafter drying the nitrocellulose particles.

In some embodiments, the stabilizing is limited to the acid, neutral and alkaline regimens, the boiling temperature is at least 115° C. and the neutral regimen and the alkaline regimen have a combined duration of less than 25 hours. The acid boil regimen, the neutral regimen and the alkaline regimen can have a combined duration of less than 45 hours. In some embodiments, the boiling temperature is at least 130° C., the acid boil duration is no more than 15 hours and the neutral regimen and the alkaline regimen have a combined duration of less than 20 hours. The acid boil regimen, the neutral regimen and the alkaline regimen can have a combined duration of less than 30 hours. In some embodiments, the boiling temperature is at least 130° C., the acid boil duration is no more than 10 hours and the neutral regimen and the alkaline regimen has a combined duration of less than 20 hours. In still further embodiments, the acid boil regimen, the neutral regimen and the alkaline regimen have a combined duration of less than 25 hours.

In these and other embodiments, the stabilized nitrocellulose particles in the propellant comprise at least 12.5% nitrogen and have a chemical stabilizer concentration of 2.0 wt %. In some embodiments, In some embodiments, the nitrocellulose particles, in cross-section, have a felted and/or non-plasticized appearance.

In these and other various embodiments, after the step of stabilizing the nitrocellulose particles and before the step of drying, the method can further comprise the step of impregnating the nitrocellulose particles with a chemical stabilizer. The step can comprise mixing the nitrocellulose particles in a chemical stabilizer solution comprising the chemical stabilizer, wherein the nitrocellulose particles have a chemical stabilizer concentration of 2.0 wt % or less.

In some embodiments, the nitrocellulose particles are nitrated sufficiently to produce nitrocellulose particles having at least 13% nitrogen. In these and various other embodiments, the cross-section length can be 250 microns to 1 mm.

In at least some embodiments, the method is a continuous process and can be performed in a single general location. Various embodiments of present invention include propellants and packaged propellants comprising propellant made by the method described herein. Further included are cartridges comprising propellant made by the methods herein.

Figure 8:
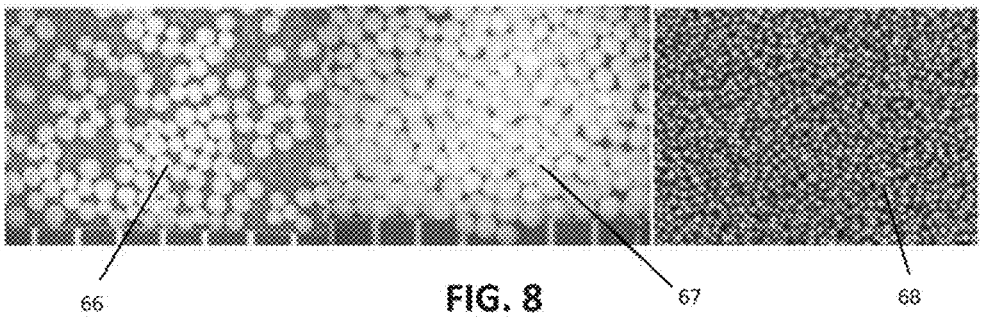
FIG. 8 shows digital images of a sample of cellulose particles at different points along a propellant production process in accordance with an embodiment of the invention.

Examples of Particle Samples at Different Points of a Propellant Production Process:

FIG. 8 illustrates examples of samples of cellulose particles used as starting material taken from different points along a propellant production process. Shown in the figure are MCC spheres (Vivapur 350, 700 spheres) 66 on the left as the starting cellulose particles; nitrated MCC spheres 67 are shown in the middle; and double base coated cellulose propellant spheres 68 are shown on the right. Nitration conditions for the samples included $H_2SO_4/HNO_3/H_2O$ (43.5%/50%/6.5%) nitrating acid; temperature—40C; duration—1 hour; and A/C about 30. Such propellant formation can be used as rifle powder.

Figure 9:
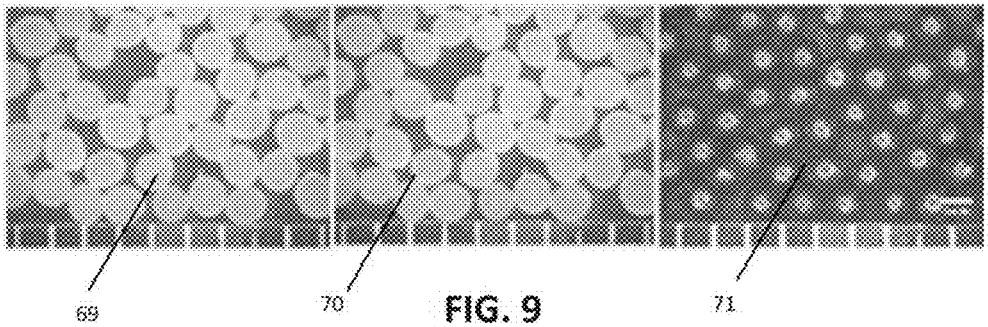
FIG. 9 shows digital images of a sample of cellulose particles at different points along a propellant production process in accordance with an embodiment of the invention.

FIG. 9 illustrates further examples of samples of cellulose particles taken from different points along a propellant production process. Shown in the figure are lyocel spheres (500-700 um) 69 on the left as the starting cellulose particles; nitrated lyocel spheres 70 are shown in the middle; and double base coated cellulose propellant spheres 71 are shown on the right. Nitration conditions for the samples included 99% nitric acid; temperature—25C; duration—1 hr; and A/C about 35. Such propellant formation can be used as rifle powder.

Figure 10:
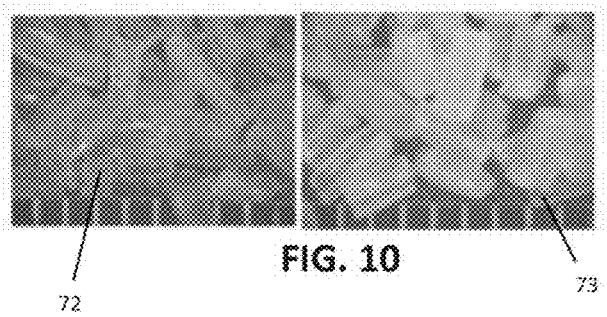
FIG. 10 shows digital images of a sample of cellulose particles at different points along a propellant production process in accordance with an embodiment of the invention.
Figure 11:
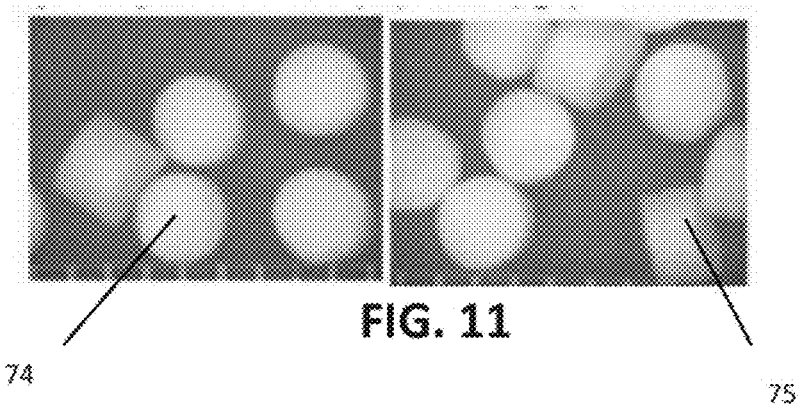
FIG. 11 shows digital images of a sample of cellulose particles at different points along a propellant production process in accordance with an embodiment of the invention.
Figure 12:
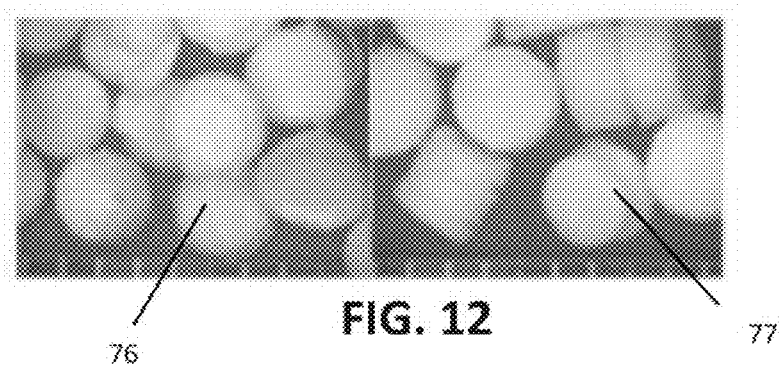
FIG. 12 shows digital images of a sample of cellulose particles at different points along a propellant production process in accordance with an embodiment of the invention.
Figure 13:
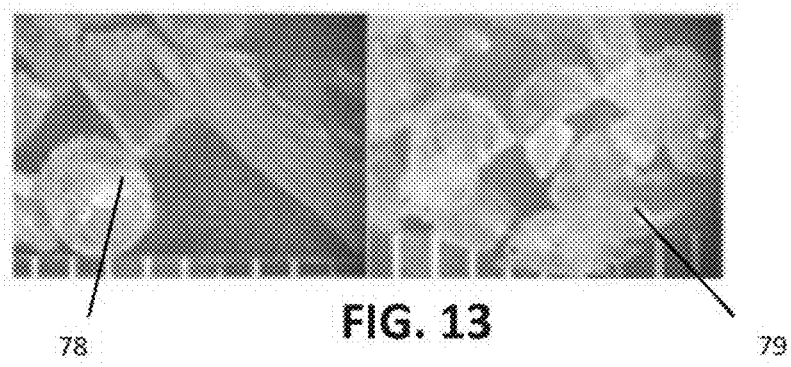
FIG. 13 shows digital images of a sample of cellulose particles at different points along a propellant production process in accordance with an embodiment of the invention.

Further examples of cellulose particles used as starting material include, but are not limited to, lyocell cylinders, samples of which are shown in FIG. 10 (pre-nitration 72 and nitrated 73), 5% CAB infused pulp, samples of which are shown in FIG. 11 (pre-nitration 74 and nitrated 75), Guar Gum infused pulp, samples of which are shown in FIG. 12 (pre-nitration 76 and nitrated 77), and ionic liquid infused/removed pulp punched from sheet (may comprise plasticizer prior to punching), samples of which are shown in FIG. 13 (pre-nitration 78 and nitrated 79). Nitration conditions for the samples in FIGS. 10-13 included various mixed acids, including $H_2SO_4/HNO_3/H_2O$ (43.5%/50%/6.5%) nitrating acid and 99% nitric acid; temperature—40C; duration—1 hour; and A/C about 30. Such propellant formation can be used as gun powder.

Figure 14:
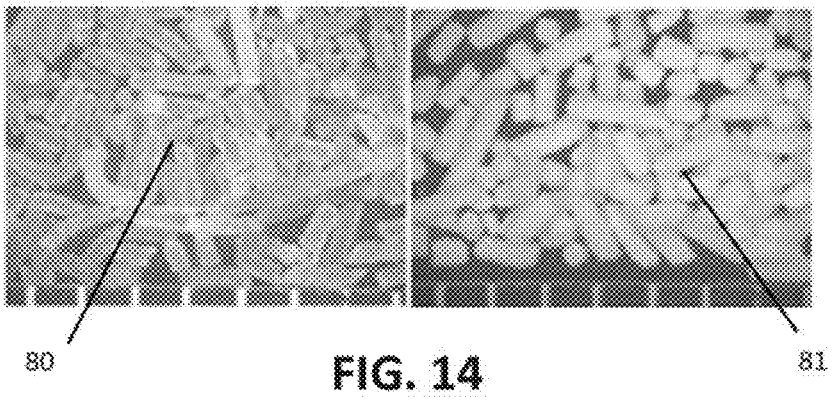
FIG. 14 shows digital images of a sample of cellulose particles at different points along a propellant production process in accordance with an embodiment of the invention.

Further examples of cellulose particles which can be used as starting material include Guar Gum pellets, samples of which are shown in FIG. 14 (pre-nitration 80 and nitrated 81). Nitration conditions for the samples in FIG. 14 included 80/20 by volume 99% nitric acid/commercial concentrated sulfuric acid; temperature—40C; duration—1 hr; and A/C about 30. After one hour at 40 C, the temperature can be dropped to 12 C for 10 minutes before recovering to reduce stickiness. Such propellant formation can be used as gun powder.

Figure 15:
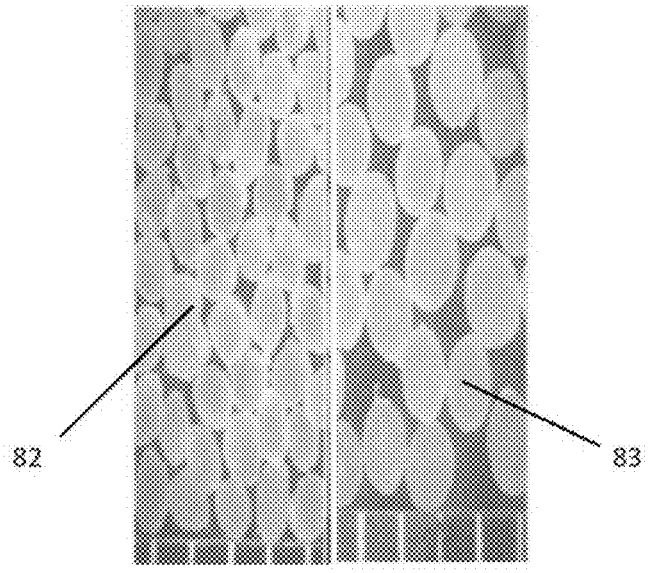
FIG. 15 shows digital images of a sample of cellulose particles at different points along a propellant production process in accordance with an embodiment of the invention.

Further examples of cellulose particles which can be used as starting material include lyocell spheres (0.8×1.1 mm), samples of which are shown in FIG. 15 (pre-nitration 82 and nitrated 83). Nitration conditions for the samples in FIG. 14 included 99% nitric acid (50 ml/g); temperature—25C, duration—45 minutes, stirring; draining; and quenching. The 1 mm nitrated spheres 83 did not exhibit splitting, collapse or rupture and fully dissolved in acetone indicating complete nitration. The NC spheres 83 were subsequently impregnated with nitroglycerine (NG) and deterrent coated and fired in various rifle calibers.

In at least some embodiments, propellant production in accordance with the methods disclosed herein demonstrated repeatability of the nitration process, the stabilization process and the deterrent coating process. In these and other various embodiments, the propellant product exhibits complete stabilization and ultimate nitrogen substitution ranges that are useful to the small arms industry.

Non-Limiting Applications

Figure 16:
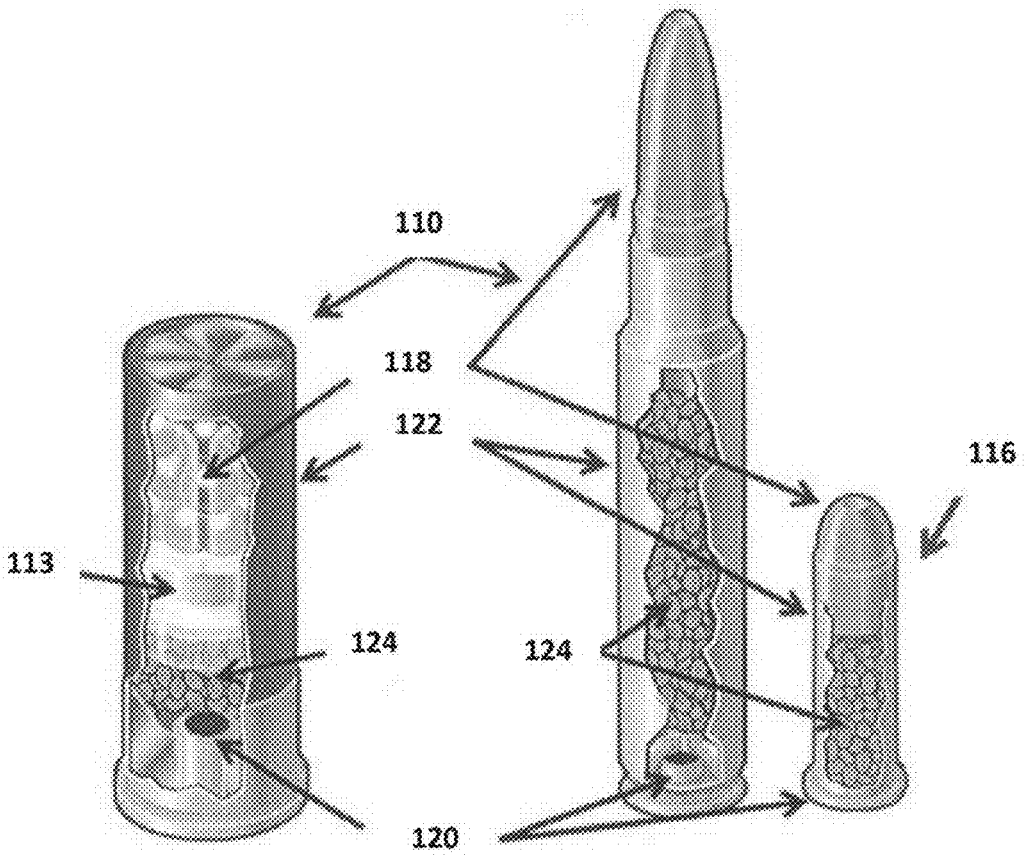
FIG. 16 is a side perspective view with partial cutaway of three types of cartridges in accordance with an embodiment of the invention.

Non-limiting examples of a final form of a propellant produced from some embodiments of the disclosure include spherical powder, rifle powder, and flake powder. Propellants produced by the methods herein can be incorporated into rifle cartridges, handgun cartridges, shotgun shell/cartridges and other small arms cartridges, both, centerfire and rimfire. FIG. 16 illustrates non-limiting examples of firearm cartridges that can incorporate the propellants disclosed herein.

There are shown two center fire cartridges 110, which include a shotgun cartridge 112, which includes a wad 113, and a rifle cartridge 114, and a rimfire projectile 116. As can be seen, each has a projectile (bullet) 118, a primer or penetrator 120 and a casing 122. In all cases, the propellant 124 is contained within the casing 122, under the projectile 118. In operation, the propellant charge 124 located in the casing 122, which is in a gun chamber, is ignited by the primer 120 upon firing of the gun. Gases produced by combustion of the propellant grains 124 cause a rapid buildup of pressure.

Suitable materials for the primer 120, the casing 122 and the projectile 118 are known in the art and are, thus, not described in detail herein. The primer 120 can be a conventional primer composition, examples of which are known in the art and, thus, are not described in detail herein. The propellant composition 124 can be substantially evenly distributed within the casing 122 of the cartridge 110. The primer 120 can be positioned substantially adjacent to the propellant composition 124 in the cartridge 110. When ignited or combusted, the propellant composition 124 can propel the projectile 118 from the barrel of the firearm (such as, without limitation, handgun, rifle, automatic rifle, machine gun) in which the cartridge 110 is disposed.

In at least some embodiments of the invention, pre-shaped nitrocellulose or NC/NG based propellant is prepared in accordance with the methods disclosed herein to produce a propellant product that is incorporated into cartridges or directional containers. In some embodiments, the propellant compositions made by the methods herein can be incorporated and used in cartridges, such as power loads. Power loads are blank cartridges or charges used in power tools, for example, power fasteners or powder actuated tools. Such tools can be used to drive fastening objects, such as fasteners, into hard surfaces, such as concrete slabs and block walls. A common use is to attach wood to concrete and concrete block.

Power loads are also known as cartridges for power devices or tools, powertool loaded round, centerfire powertool loaded round, rimfire cartridge for power device, powertool round, power hammer loads, blank power load and/or booster, power cartridge, initiator, power cell and powder load. Power loads and the various synonyms are well known in the art. Known applications include, but are not limited to, power tools, such as fastener tools/systems, separation systems, electrical disconnects, explosive switches and valves, parachute and data package ejection system, rocket motor ignition systems and any application requiring rapid gas & heat generation. Embodiments disclosed herein include such devices comprising the propellants disclosed herein and methods of making such devices using methods disclosed herein.

Figure 19:
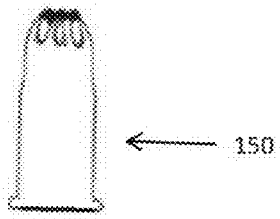
FIG. 19 is a front perspective view of a power load according to an embodiment of the invention.
Figure 20:
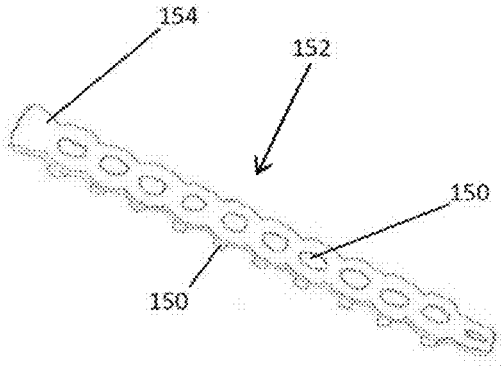
FIG. 20 is a perspective view of a power load strip according to an embodiment of the invention.
Figure 21:
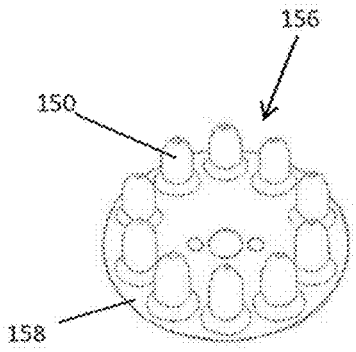
FIG. 21 is a perspective view of a power load disc according to an embodiment of the invention.

Power loads can be in the form of a cartridge (excluding the projectile), such as the power load cartridge 150 shown in FIG. 19. Multiple power loads 150 can be fastened to a substrate, such as a strip 154 or a disc 158, that is adapted for use in a power fastener or powder actuated tool so as to allow for repeat firing without reloading after each firing. FIGS. 20 and 21, respectively, show examples of a power load strip 152 and a power load disc 156. Various exemplary charges include, but are not limited to, 22, 25, 27, 32, and 38 calibers.

Power loads can also be at least partially colored and referred to as, in descending level of power, purple charge, red charge, yellow charge, green charge, brown charge and black charge, based on the incorporated charge power. In some embodiments, the propellants disclosed herein are incorporated into 22 and/or 27 caliber power loads or cartridges. Embodiments further include incorporating such power loads or cartridges in discs and/or strips suitable for use in power actuated tools. Exemplary power actuated tools include, but are not limited to, fastening tools and systems, semi-automatic and/or automatic.

Power loads can comprise single base (NC) or double base propellant in accordance with the present invention. Power loads can further comprise various other components including, but not limited to, iron, copper, zinc, dibutyl phthalate and normal lead styphate.

In at least one embodiment of the present invention, a pre-shaped propellant product is formed in accordance with the methods disclosed herein and exhibits complete stabilization and ultimate nitrogen substitution ranges that are useful to the small arms or fastening tool industry. The propellant product is then delivered to a power load manufacturer, wherein the propellant is incorporated into power loads. The power load is suitable for use in power actuated tools, such as fastening tools. In some embodiments, the power load is incorporated into a strip which is suitable for loading in a power actuated tool for driving fasteners, such as nails. In some embodiments, the power load is incorporated into a disc, which is suitable for loading in a power actuated tool for driving fasteners, such as nails. In some embodiments, the power load is in the form of single cartridge, which is suitable for loading in strips or discs for or directly into a power actuated tool for driving fasteners, such as nails.

As non-limiting examples, in some embodiments, the propellant compositions can be used as or incorporated into primer fines, power loads, blank loads, such as 22 caliber blanks, rimfire and center fire cartridges, pistol, handgun, shotgun and/or rifle cartridges, including small and medium calibers, and shot shell cartridges. Examples of medium caliber include direct fire ammunition between about 20 mm and about 40 mm.

The propellant compositions can be loaded into the cartridge using conventional techniques, such as those used in loading conventional propellant compositions, which are not described in detail herein.

In some embodiments, the propellant compositions made by the methods herein are further used as powder charge and incorporated and used in shot shell cartridges. Examples of shot shell cartridges include, but are not limited to, 10, 12 and 20 gauge shells and shell lengths of 2¾, 3 and 3½ inches.

In some embodiments, the propellant compositions made by the methods herein are further incorporated and used in rifle cartridges. Examples of rifle cartridges include, but are not limited to 5.56 mm, 7.62 mm and 50 cal.

In at least one embodiment of the present invention, a pre-shaped propellant product is formed in accordance with the methods disclosed herein and exhibits complete stabilization and ultimate nitrogen substitution ranges that are useful to the small arms industry. The propellant product is then delivered to a cartridge manufacturer, wherein the propellant is incorporated into cartridges suitable for use in a firearm.

In some embodiments, the propellant compositions made by the disclosed methods can further be used in weapon systems or accessories, for example as reloading propellant for muzzle loading projectiles. The propellant can be packaged and used in reloading applications, for example, as propellant charges for muzzle loading applications.

In some embodiments, the propellant compositions made by the disclosed methods can further be used as or in propellant for nail guns and mortar, medium caliber and grenade launchers.

In some embodiments, the propellant compositions made by the methods herein are further incorporated and used in rimfire cartridges. Examples of rimfire cartridges include, but are not limited to, 22LR and 17HMR.

In some embodiments, the propellant compositions made by the methods herein are further incorporated and used in pistol cartridges. Examples of pistol cartridges include, but are not limited to 9 mm, 45 ACP and 40 S&W.

In at least one embodiment, a pre-shaped propellant product is formed in accordance with the methods disclosed herein and exhibits complete stabilization and ultimate nitrogen substitution ranges that are useful to the rocket motor and/or motor ignition system industry. The propellant product is then delivered to a rocket motor(s) and/or motor ignition system(s) manufacturer, wherein the propellant is incorporated into rocket motor(s) and/or motor ignition system(s) and useful therein.

In at least one embodiment of the present invention, there is disclosed herein a method of obtaining a propellant product for incorporation into or use with a device unitizing the propellant product. The method comprises a customer ordering the propellant product and specifying a particular shape and dimension of particles of the propellant product; a manufacturer receiving the order and thereafter preparing the propellant product with the specified particle shape and dimension in accordance with the methods disclosed herein; the manufacturer then delivering the finalized propellant product to the customer; and thereafter the customer incorporating the propellant product into the device. The device is either used or provided to further customers for use. In some embodiments, the device is a cartridge.

In at least one embodiment, the present invention comprises a commercial package. The commercial package comprises a quantity of she propellant disclosed herein. In this and other various embodiments, the commercial package further comprises documents containing information about the propellant and intended use.

In at least one embodiment, she present invention is directed to a method of marketing a propellant in accordance with the present invention, comprising packaging the propellant along with labeling that identifies the propellant as being useful for use in cartridges.

The states of the projectiles, power loads, etc., devices and/or systems incorporating the propellants of the disclosure include unspent, unfired and prefired states and undeformed and ready for conventional use.

The examples herein serve to explain further embodiments of the method and propellant composition. These examples are not to be construed as being exhaustive or exclusive as to the scope of this disclosure.

All patents, patent applications and publications thereof, scientific papers, and any other referenced materials mentioned anywhere herein are incorporated herein by reference in their entirety for all purposes, including in providing materials, formulations, formulation methods and methods for making, performing and using as they relate to the methods and compositions of the present invention. Furthermore, the invention encompasses any possible combination of some or all of the various embodiments described herein and incorporated herein.

The present disclosure shall not be limited by the exact apparatuses shown or described and includes those conventional apparatuses that perform the same or similar functions, as one skilled in the art would understand it.

All of the features disclosed in this specification (including the references incorporated by reference, including any accompanying claims, abstract and drawings), and/or all of the steps of any method or process so disclosed, can be combined in any combination, except combinations where at least some of such features and/or steps are mutually exclusive.

Each feature disclosed in this specification (including references incorporated by reference, any accompanying claims, abstract and drawings) can be replaced by alternative features serving the same, equivalent or similar purpose, unless expressly stated otherwise. Thus, unless expressly stated otherwise, each feature disclosed is one example only of a generic series of equivalent or similar features.

The disclosure is not restricted to the details of the foregoing embodiment(s). The disclosure extends to any novel one, or any novel combination, of the features disclosed in this specification (including any incorporated by reference references, any accompanying claims, abstract and drawings), or to any novel one, or any novel combination, of the steps of any method or process so disclosed. The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the disclosure be defined by the attached claims and their legal equivalents, as well as the following illustrative aspects. The above described aspects embodiments of the disclosure are merely descriptive of its principles and are not to be considered limiting. Further modifications of the disclosure herein disclosed will occur to those skilled in the respective arts and all such modifications are deemed to be within the scope of the disclosure.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range.

For purposes of interpreting the claims for the present disclosure, it is expressly intended that the provisions of Section 112, sixth paragraph of 35 U.S.C. are not to be invoked unless the specific terms "means for" or "step for" are recited in a claim.

The invention claimed is:

1. A method of making a propellant for use in firearm cartridges, wherein the propellant comprises particles comprising nitrocellulose and having a final shape and size, the method comprising nitrating preshaped particles comprising cellulose and having a size of at least 50 microns to form particles comprising nitrocellulose and thereafter stabilizing the particles by a series of boiling regimens, whereby the particles are completely stabilized and wherein the final shape is the same as the preshaped particles.

2. The method of claim 1, further comprising:

providing an amount of the preshaped particles, the preshaped particles comprising cellulose and having a size of at least 50 microns and having a shape of the final shape; thereafter nitrating the preshaped particles sufficiently to produce the particles comprising nitrocellulose having at least 12% nitrogen at a location; thereafter, at the location, stabilizing the particles by the series of boiling regimens, wherein the stabilizing comprises the steps of:

subjecting the particles to an acid boil regimen comprising boiling the particles in an acid boil solution at an elevated temperature of at least 115° C. for a period of no more than 30 hours, the acid boil solution comprising substantially water; thereafter subjecting the particles to a first neutral boiling of the particles in a first neutral solution for a period of time, the first neutral solution comprising substantially water; and thereafter subjecting the particles to a first alkaline boiling of the particles in a first alkaline solution for a period of time, the first alkaline solution comprising substantially water, wherein the combined periods of time of the first neutral boiling and the first alkaline boiling is less than 30 hours, whereby the particles are completely stabilized and exhibit complete nitration and wherein the shape is maintained; and thereafter drying the particles.

3. The method of claim 2, wherein the stabilizing is limited to the acid, neutral and alkaline regimens, the neutral regimen and the alkaline regimen having a combined duration of less than 25 hours and the acid boil regimen, the neutral regimen and the alkaline regimen having a combined duration of less than 45 hours.

4. The method of claim 2, wherein, after the step of stabilizing the particles and before the step of drying, the method further comprises the step of:

impregnating the particles with a chemical stabilizer, comprising mixing the nitrocellulose particles in a chemical stabilizer solution comprising the chemical stabilizer, wherein the particles have a chemical stabilizer concentration of 2.0 wt % or less.

5. The method of claim 2, wherein the particles are nitrated sufficiently to produce particles having at least 13% nitrogen and, in cross-section, have a felted and/or non-plasticized appearance.

6. The method of claim 2, wherein the cross-section length is 250 microns to 1 mm.

7. The method of claim 1, further comprising:

providing an amount of the preshaped particles comprising cellulose, the preshaped particles having a size of at least 50 microns and having a shape of the final shape; thereafter nitrating the preshaped particles sufficiently to produce the particles comprising nitrocellulose and having at least 12% nitrogen at a location; thereafter, at the location, stabilizing the particles by the series of boiling regimens, wherein the stabilizing comprises the steps of:

subjecting the particles to an acid boil regimen comprising boiling the particles in an acid boil solution for an amount of time, the acid boil solution comprising substantially water; thereafter subjecting the particles to an organic solvent solution boil regimen, the organic solvent solution boil regimen comprising:

a first organic solvent boiling of the particles in a first organic solvent solution for a first solvent boil period of time, the first organic solvent solution comprising ethanol; and thereafter a second organic solvent boiling of the particles in a second organic solvent solution for a second solvent boil period of time, the second organic solvent solution comprising ethanol; and subjecting the nitrocellulose particles to an alkaline boil regimen, the alkaline boil regimen comprising:

a first alkaline boiling of the particles in a first alkaline solution for a first alkaline boil period of time, the first alkaline solution comprising substantially water, whereby the particles are completely stabilized and exhibit complete nitration and wherein the shape is maintained; and thereafter drying the particles; and combining the particles with one or more propellant components included in the propellant, wherein the particles form energetic particles of the propellant and the shapes of the preshaped particles are substantially maintained in the propellant.

8. The method of claim 7, the preshaped particles having a cross-section length of at least 100 microns and the particles being nitrated to comprise at least 12.5% nitrogen, wherein the stabilizing further comprises:

subjecting the particles to a neutral boil regimen prior to the organic solvent solution boil regimen, the neutral boil regimen comprising:

a first neutral boiling of the particles in a first neutral solution for a first neutral boil period of time, the first neutral solution comprising substantially water, and wherein the alkaline boil regimen further comprises:

a second alkaline boiling of the particles in a second alkaline solution for a second alkaline boil period of time, the second alkaline solution comprising substantially water, wherein the stabilized particles in the propellant have a chemical stabilizer concentration of 2.0 wt % or less; and, in cross-section, have a felted and/or non-plasticized appearance.

9. The method of claim 1, wherein the preshaped particles comprise one or more of an energetic plasticizer, a nitrate ester and an energetic solid.

10. The method of claim 9, wherein the preshaped particles comprise guar and the energetic solid comprises RDX.

11. A propellant for firearm cartridges, wherein the propellant comprises separate particles comprising nitrocellulose and having a final shape and size, being completely stabilized and having a chemical stabilizer concentration of 2.0 wt % or less, the particles being prepared by a method comprising:

providing an amount of the preshaped particles, the preshaped particles comprising cellulose and having a size of at least 50 microns and having a shape of the final shape; thereafter nitrating the preshaped particles sufficiently to produce the particles comprising nitrocellulose having at least 12% nitrogen at a location; thereafter, at the location, stabilizing the particles by a series of boiling regimens, wherein the stabilizing comprises the steps of:

subjecting the particles to an acid boil regimen comprising boiling the particles in an acid boil solution at an elevated temperature of at least 115° C. for a period of no more than 30 hours, the acid boil solution comprising substantially water; thereafter subjecting the particles to a first neutral boiling of the particles in a first neutral solution for a period of time, the first neutral solution comprising substantially water; and thereafter subjecting the particles to a first alkaline boiling of the particles in a first alkaline solution for a period of time, the first alkaline solution comprising substantially water, wherein the combined periods of time of the first neutral boiling and the first alkaline boiling is less than 30 hours, whereby the particles are completely stabilized and exhibit complete nitration and wherein the shape is maintained; and thereafter drying the particles.

12. The propellant of claim 11, wherein the stabilizing is limited to the acid, neutral and alkaline regimens and the neutral regimen and the alkaline regimen have a combined duration of less than 25 hours.

13. The propellant of claim 11, the stabilizing step further comprising:

subjecting the particles to an organic solvent solution boil regimen, the organic solvent solution boil regimen comprising:

a first organic solvent boiling of the particles in a first organic solvent solution for a first solvent boil period of time, the first organic solvent solution comprising ethanol; and thereafter a second organic solvent boiling of the particles in a second organic solvent solution for a second solvent boil period of time, the second organic solvent solution comprising ethanol; and combining the particles with one or more propellant components included in the propellant, wherein the particles are energetic particles of the propellant and the shapes of the preshaped particles are substantially maintained in the propellant.

14. The propellant of claim 11, the preshaped particles having a cross-section length of at least 100 microns and the particles being nitrated to comprise at least 12.5% nitrogen.

15. The propellant of claim 11, wherein the preshaped particles comprise one or more of an energetic plasticizer, a nitrate ester and an energetic solid.

16. The propellant of claim 15, wherein the preshaped particles comprise an energetic solid, the energetic solid being chosen from the group consisting of RDX and HMX.

17. The propellant of claim 15, wherein the preshaped particles comprise guar and the energetic solid comprises RDX.

18. A propellant for use in firearm cartridges, wherein the propellant comprises separate particles comprising nitrocellulose and having a final shape, the propellant being prepared by nitrating preshaped particles comprising cellulose, having sizes that include a cross-section length of at least 50 microns and having a shape consistent with the final shape to form particles comprising nitrocellulose; and then stabilizing the particles, whereby the particles are completely stabilized and exhibit complete nitration and wherein the shape is maintained, wherein the stabilized particles in the propellant comprise at least 12.5% nitrogen; have a chemical stabilizer concentration of 2.0 wt % or less; and in cross-section, have a felted and/or non-plasticized appearance.

19. The method of claim 9, wherein the preshaped particles comprise an energetic solid, the energetic solid being chosen from the group consisting of RDX and HMX.

20. The propellant of claim 18, wherein the preshaped particles comprise one or more of an energetic plasticizer, a nitrate ester and an energetic solid.

21. The propellant of claim 20, wherein the preshaped particles comprise an energetic solid, the energetic solid being chosen from the group consisting of RDX and HMX.

22. The propellant of claim 20, wherein the preshaped particles comprise guar and the energetic solid comprises RDX.

* * * * *